US008174212B2

(12) United States Patent
Tziony et al.

(10) Patent No.: US 8,174,212 B2
(45) Date of Patent: May 8, 2012

(54) LED STRING DRIVER WITH LIGHT INTENSITY RESPONSIVE TO INPUT VOLTAGE

(75) Inventors: Noam Tziony, Petach Tikva (IL); Alon Ferentz, Bat Yam (IL); Roni Blaut, Netanya (IL); David Pincu, Holon (IL); Chanoch Kahn, Jerusalem (IL)

(73) Assignee: Microsemi Corp.—Analog Mixed Signal Group Ltd., Hod Hasharon (IL)

( * ) Notice: Subject to any disclaimer, the term of this patent is extended or adjusted under 35 U.S.C. 154(b) by 305 days.

(21) Appl. No.: 12/624,431

(22) Filed: Nov. 24, 2009

(65) Prior Publication Data

US 2010/0134018 A1 Jun. 3, 2010

Related U.S. Application Data

(60) Provisional application No. 61/118,611, filed on Nov. 30, 2008, provisional application No. 61/142,399, filed on Jan. 5, 2009.

(51) Int. Cl.
*H05B 37/02* (2006.01)

(52) U.S. Cl. ..... 315/309; 315/122; 315/185 R; 315/306

(58) Field of Classification Search ..... 315/185 R, 315/192, 193, 225, 291, 307, 312, 122, 306, 315/309
See application file for complete search history.

(56) References Cited

U.S. PATENT DOCUMENTS

| | | | | |
|---|---|---|---|---|
| 3,969,672 | A * | 7/1976 | Wallander et al. | 324/133 |
| 6,153,980 | A * | 11/2000 | Marshall et al. | 315/200 A |
| 6,621,235 | B2 | 9/2003 | Chang | |
| 7,042,165 | B2 | 5/2006 | Madhani et al. | |
| 7,172,314 | B2 | 2/2007 | Currie et al. | |
| 7,224,128 | B2 | 5/2007 | Hsu | |
| 7,339,323 | B2 | 3/2008 | Bucur | |
| 7,352,138 | B2 | 4/2008 | Lys et al. | |
| 7,358,679 | B2 | 4/2008 | Lys et al. | |
| 7,425,943 | B2 * | 9/2008 | Furukawa | 345/102 |
| 7,445,340 | B2 | 11/2008 | Conner et al. | |
| 7,649,326 | B2 * | 1/2010 | Johnson et al. | 315/291 |
| 7,781,979 | B2 * | 8/2010 | Lys | 315/185 S |
| 2005/0231459 | A1 | 10/2005 | Furukawa | |
| 2006/0244396 | A1 * | 11/2006 | Bucur | 315/312 |
| 2008/0150439 | A1 | 6/2008 | Bucur | |
| 2008/0157687 | A1 | 7/2008 | Lin | |
| 2008/0170012 | A1 | 7/2008 | S et al. | |
| 2008/0203946 | A1 * | 8/2008 | Ito et al. | 315/307 |
| 2010/0019681 | A1 | 1/2010 | Deixler et al. | |
| 2010/0109557 | A1 * | 5/2010 | Bouchard | 315/294 |

FOREIGN PATENT DOCUMENTS

| | | | |
|---|---|---|---|
| WO | 97/29320 | | 8/1997 |
| WO | 01/01385 | A1 | 1/2001 |
| WO | 2008/099979 | A2 | 2/2007 |

* cited by examiner

*Primary Examiner* — Tung X Le
(74) *Attorney, Agent, or Firm* — Simon Kahn

(57) ABSTRACT

A driving arrangement for a plurality of light emitting diodes (LEDs), the driving arrangement constituted of: a plurality of serially connected first LEDs coupled to a source voltage; a plurality of first electronically controlled switches, each associated with a particular one of the plurality of serially connected first LEDs and arranged to provide, when closed, a bypass current path for the associated first LED; and a control circuitry coupled to a control terminal of each of the plurality of first electronically controlled switches, the control circuitry operative to close a number of the plurality of first electronic switches, the number responsive to a voltage level of the source voltage.

6 Claims, 14 Drawing Sheets

LED STRING DRIVER WITH LIGHT INTENSITY RESPONSIVE TO INPUT VOLTAGE

CROSS-REFERENCE TO RELATED APPLICATIONS

This application claims priority from U.S. Provisional Patent Application Ser. No. 61/118,611 filed Nov. 30, 2009 entitled "LED String Driver with Light Intensity Responsive to Input Voltage" the entire contents of which are incorporated herein by reference; and U.S. Provisional Patent Application Ser. No. 61/142,399 filed Jan. 5, 2009 entitled "LED String Driver with Light Intensity Responsive to Input Voltage" the entire contents of which are incorporated herein by reference.

TECHNICAL FIELD

The present invention relates to the field of solid state lighting, and particular to an LED string driver whose output light intensity is responsive to the input voltage.

BACKGROUND

Solid state lighting is rapidly expanding its penetration, bringing to the market increased lighting efficiency, longer life and additional capabilities. One example of solid stage lighting is the use of light emitting diodes (LEDs), which are available in a plurality of colors. By combining the optical output of a plurality of colored LEDs a range of colors may be output. In one non-limiting example, the use of red, green and blue LEDs placed in proximity and behind a diffuser closes a complete range of colors by adjusting the relative intensity of the constituent LEDs, while the overall intensity of the constituent LEDs may be further adjusted to control the average overall luminance. Alternatively, LEDs producing a white output light are available, the white output typically being a result of a native blue or ultraviolet LED whose optical output excites a phosphor coating.

In order to economically control a large plurality of LEDs together producing sufficient light, the LEDs are typically supplied as a serially connected LED string, thereby sharing a single current. Each of the LED strings may be intensity controlled by one or both of amplitude modulation (AM), in which the value of the current through the LED string is adjusted, and pulse width modulation (PWM) in which the duty rate is controlled to adjust the average intensity over time. Thus, total intensity and color may be controlled by any combination of AM and PWM.

One of the challenges of solid state lighting, and LED lighting in particular, is to be directly compatible with current lighting fixtures and installations. Thus, in an ideal world, an incandescent bulb would be directly replaceable with a solid state lighting equivalent, without requiring a change in sockets, switches or dimmers. Certain solid state lighting solutions based on LED strings have been produced which fit into current lighting sockets, however the performance in cooperation with standard dimmer installations, which are typically thyristor based dimmers, have been less than satisfactory.

SUMMARY

In view of the discussion provided above and other considerations, the present disclosure provides methods and apparatus to overcome some or all of the disadvantages of prior and present LED string driving methods and apparatuses. Other new and useful advantages of the present methods and apparatus will also be described herein and can be appreciated by those skilled in the art.

This is provided in certain embodiments by a driving arrangement comprising a plurality of serially connected LEDs, with a plurality of electronically controlled switches, each of the electronically controlled switches arranged to provide a bypass path for a respective one of the serially connected LEDs. The electronically controlled switches are controlled so as to bypass serially connected LEDs in reverse proportion to a supply voltage. As the supply voltage increases, fewer of the serially connected LEDs are bypassed, and the output light increases, and as the supply voltage decreases, more of the serially connected LEDs are bypassed, and the output light decreases.

In one embodiment, one end of the serially connected LEDs is connected to a current source, preferably a controlled current source. In another embodiment, one end of the serially connected LEDs is connected to a current sensor.

In one embodiment, the control inputs of the plurality of electronically controlled switches are coupled together. In one further embodiment, the control inputs are coupled together to the control input of an electronically controlled switch of the current source.

In one embodiment, the control inputs of the electronically controlled switches are coupled to the output of a control unit, the control unit operative responsive to a rising voltage across the current sensor or current source to open at least one of the bypassing electronically controlled switches. Preferably, the electronically controlled switches are opened sequentially.

In one embodiment, the control inputs of the electronically controlled switches are coupled to the output of a control unit, the control unit operative responsive to a falling voltage across the current sensor or current source to close at least one of the bypassing electronically controlled switches. Preferably, the electronically controlled switches are closed sequentially.

In one embodiment, the control inputs of the plurality of electronically controlled switches are coupled to nodes of a common voltage divider, with one terminal of each of the electronically controlled switches coupled to a common point.

In one embodiment the driving arrangement further comprises a fixed LED string connected in series with the serially connected LEDs, the fixed LED string providing a predetermined voltage drop and a minimum illumination.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
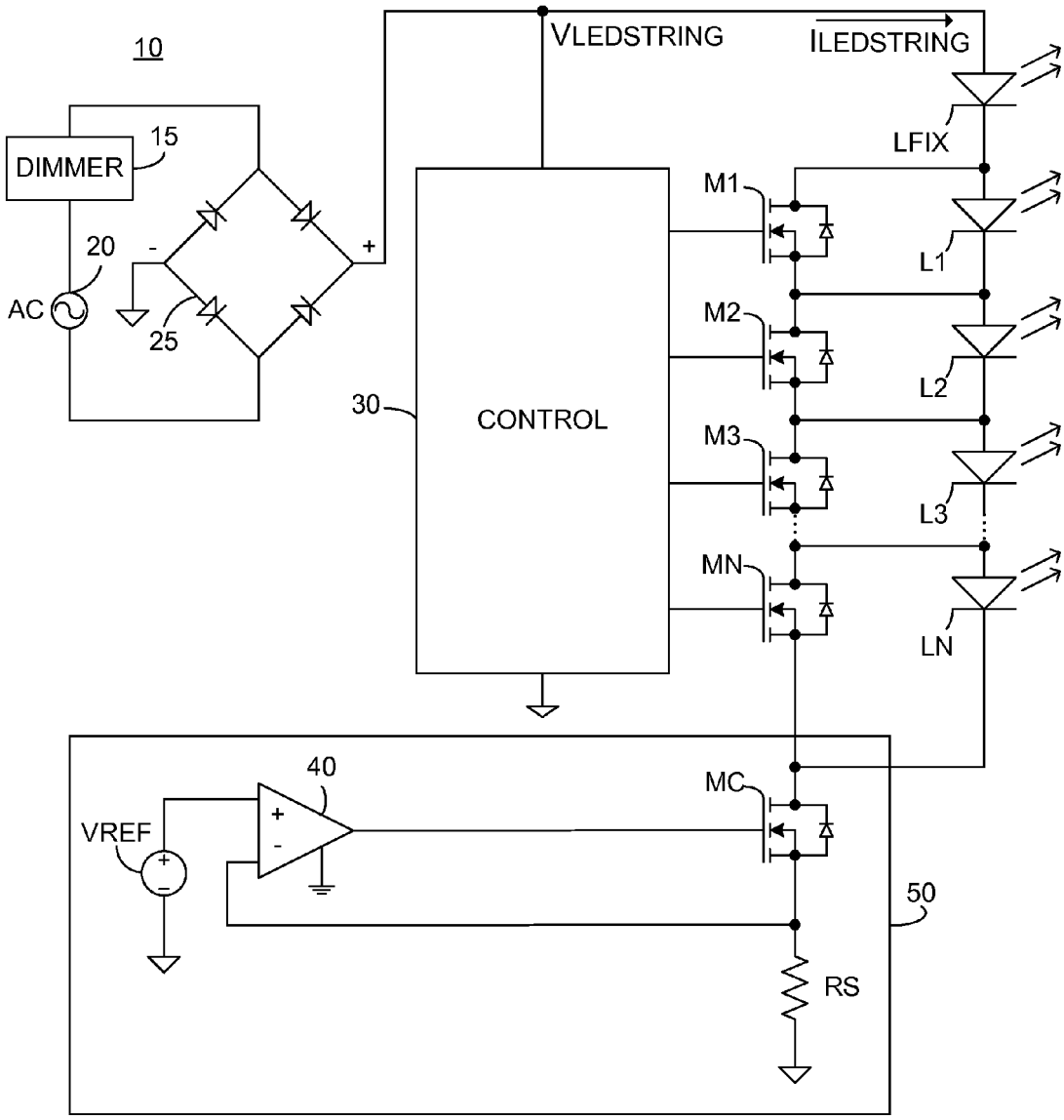
FIG. 1 illustrates a high level schematic diagram of a driving arrangement comprising a controlled current source, where the control inputs of the electronically controlled switches are coupled to the output of a control unit according to an exemplary embodiment.

Certain of the present embodiments enable a driving arrangement comprising a plurality of serially connected LEDs, with a plurality of electronically controlled switches, each of the electronically controlled switches arranged to provide a bypass path for each of the serially connected LEDs. The electronically controlled switches are controlled so as to bypass serially connected LEDs in reverse proportion to a supply voltage. As the supply voltage increases, fewer of the serially connected LEDs are bypassed, and the output light increases, and as the supply voltage decreases, more of the serially connected LEDs are bypassed, and the output light decreases. Preferably the LEDs are arranged behind a diffuser such that an average light intensity is experienced by the user. In one particular embodiment, LEDs that are lit during a larger portion of the driving voltage are closer to the diffuser, thereby reducing any flickering effect of the LEDs lit during a smaller portion of the driving voltage.

Advantageously, certain embodiments can be directly connected to a mains power outlet, without requiring a voltage transformer, DC/DC converter, large electrolytic capacitors or inductors. Such an arrangement results in a reduced mean time before failure. The LEDs light in concert with the waveform, and thus the AC ripple need not be filtered.

Certain embodiments are operative in cooperation with a thyristor based dimmer, or any conventional dimmer, since the LEDs light in concert with the waveform. Thus, as the waveform is cut by the dimmer, the amount of light produced by the serially connected LEDs reflects the remaining waveform.

Advantageously, certain embodiments can be connected to a source of DC voltage whose value is not carefully controlled or may vary over a predefined range. For example, power delivered over communication cabling according to IEEE 802.3af, known as power over Ethernet, may vary from 36 volts to 57 volts, and certain embodiments are operative to produce acceptable lighting over the range of voltages delivered by power over Ethernet without requiring a DC/DC converter. In yet another example, a DC/DC converter not exhibiting a closed feedback loop may be provided, since certain embodiments are operative to produce acceptable lighting over the range of design voltages of the DC/DC converter.

In one embodiment the LEDs are arranged in a linear fashion producing a bar graph effect, in which the number of lit LEDs exhibits a visual indicator of the instantaneous driving voltage value.

Before explaining at least one embodiment in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term connected as used herein is not meant to be limited to a direct connection, and the use of appropriate resistors, capacitors and inductors does not exceed the scope thereof.

FIG. 1 illustrates a high level schematic diagram of a driving arrangement 10 according to an exemplary embodiment, comprising: a dimmer 15; a source of AC power 20; a full-wave rectifier 25; a control unit 30; a plurality of LEDs L1, L2, L3 . . . LN; a plurality of electronically controlled switches M1, M2, M3 . . . MN, each associated with a particular light emitting diode L1, L2, L3 . . . LN; an optional additional LED LFIX; and a current source 50, comprising an electronically controlled switch MC, a sense resistor RS, a fixed reference voltage VREF and a differential amplifier 40. In one embodiment each of the electronically controlled switches MC, M1, M2, M3 . . . MN are implemented as FETs, and are illustrated as NMOSFETs, however this is not meant to be limiting in any way. Driving arrangement 10 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single optional additional LED LFIX is illustrated, however this is not meant to be limiting in any way, and a plurality of additional LEDs may be inserted serially connected to additional LED LFIX without exceeding the scope. Driving arrangement 10 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope.

The phase side of source of AC power 20 is connected the input of dimmer 15 and the output of dimmer 15 is connected to a first input of full-wave rectifier 25. The neutral side of source of AC power 20 is connected to a second input of full-wave rectifier 25. The negative output of full-wave rectifier 25 is connected to a common point. The positive output of full-wave rectifier 25 is connected to the input of control unit 30 and the anode of LED LFIX, and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and to the drain of electronically controlled switch M1. The cathode of LED L1 is connected to the anode of LED L2, to the source of electronically controlled switch M1 and to the drain of electronically controlled switch M2. The cathode of LED L2 is connected to the anode of LED L3, to the source of electronically controlled switch M2 and to the drain of electronically controlled switch M3. The cathode of LED L3 is connected to the anode of LED LN, to the source of electronically controlled switch M3 and to the drain of electronically controlled switch MN. The cathode of LED LN is connected to the source of electronically controlled switch MN and the drain of electronically controlled switch MC. The gate of each of electronically controlled switches M1, M2, M3 . . . MN is connected to a respective output of control unit 30. Control unit 30 is further connected to the common point. The source of electronically controlled switch MC is connected to a first end of sense resistor RS and to the inverting input of differential amplifier 40. The gate of electronically controlled switch MC is connected to the output of differential amplifier 40. A second end of sense resistor RS is connected to the common point. The non-inverting input of differential amplifier 40 is connected to the positive output of fixed reference voltage VREF.

In operation, a user input is received at dimmer 15. Responsive to user input, dimmer 15 phase controls the AC sine wave being received by full-wave rectifier 25, reflecting a desired luminance. Full wave rectifier 25 rectifies the received phase controlled AC signal, and outputs voltage VLEDSTRING, a full wave rectified version of the received phase controlled AC signal, received by the anode of additional LED LFIX and control unit 30. Responsive to the instantaneous received voltage VLEDSTRING, control unit 30 opens or closes certain ones of electronically controlled switches M1, M2, M3 . . . MN. In particular, as the instantaneous value of voltage VLEDSTRING increases more of electronically controlled switches M1, M2, M3 . . . MN are opened, thereby increasing the number of LEDs L1, L2, L3 . . . LN carrying current, preferably sequentially. LEDs for which the associated electronically controlled switch is closed, are bypassed and do not provide illumination, while LEDs for which the associated electronically controlled switch is open experience current flow there through with a resultant illumination. Thus, a larger phase control by dimmer 15, results in a reduced amount of time during which LED LFIX and certain of the LEDs L1, L2, L3 . . . LN are illuminated, and a smaller phase control by dimmer 15 results in an increased amount of time during which LED LFIX and certain of the LEDs L1, L2, L3 . . . LN are illuminated.

Current source 50 is operative to control current ILEDSTRING flowing there through to be at a desired level, as follows. Current ILEDSTRING flows through electronically controlled switch MC and through sense resistor RS, developing a voltage across sense resistor RS. Differential amplifier 40 compares the voltage drop across sense resistor RS with fixed reference voltage VREF. In the event that the voltage drop across sense resistor RS is less than the value of fixed reference voltage VREF, the output of differential amplifier 40 is driven towards the positive supply rail of differential amplifier 40, and electronically controlled switch MC is driven to be fully closed, i.e. exhibits a minimum $RDS_{on}$. As the voltage drop across sense resistor RS increases and approaches fixed reference voltage VREF, the output of differential amplifier 40 decreases towards zero, thereby increasing the resistance exhibited by electronically controlled switch MC.

The above has been described in an embodiment in which control unit 30 receives voltage VLEDSTRING as an input, however this is not meant to be limiting in any way. In another embodiment (not shown) the input of control unit 30 is connected to one of the drain of electronically controlled switch MC and the output of differential amplifier 40. Operation of this embodiment will be further described below in relation to FIGS. 3A-3C, 4, 5A, 5B, 7, and 8, and in general control unit 30 is operative to determine the value of voltage VLEDSTRING based on the voltages detected at one of the drain of electronically controlled switch MC and the output of differential amplifier 40.

Figure 2A:
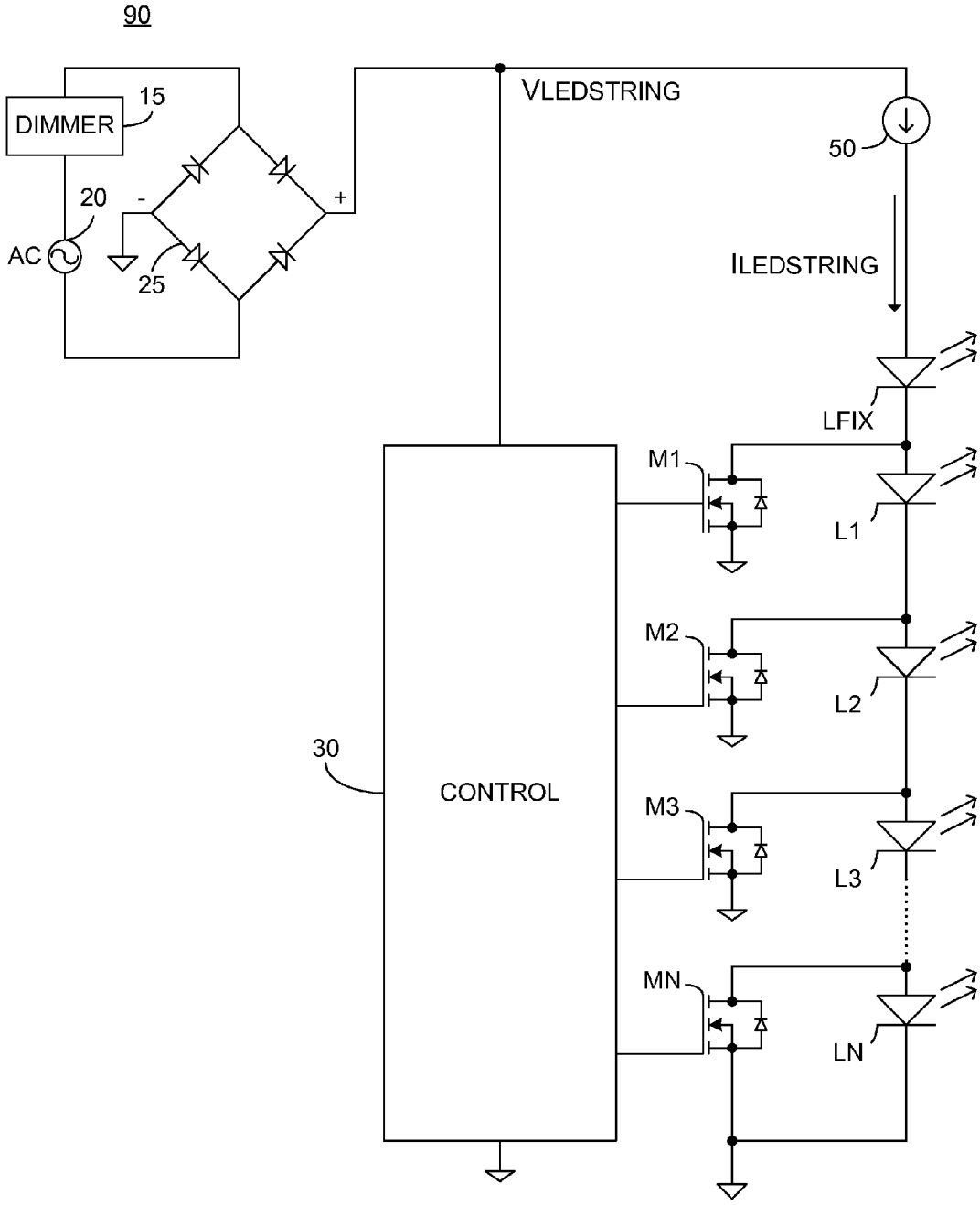
FIG. 2A illustrates a high level schematic diagram of a driving arrangement comprising a current source and a control unit, the driving arrangement coupled to a rectified AC voltage source according to an exemplary embodiment.

FIG. 2A illustrates a high level schematic diagram of a driving arrangement 90 according to an exemplary embodiment, comprising: a dimmer 15; a source of AC power 20; a full-wave rectifier 25; a control unit 30; a current source 50; a plurality of LEDs L1, L2, L3 . . . LN; a plurality of electronically controlled switches M1, M2, M3 . . . MN, each associated with a particular light emitting diode L1, L2, L3 . . . LN; and an optional additional LED LFIX. In one embodiment each of the electronically controlled switches M1, M2, M3 . . . MN are implemented as FETs, and are illustrated as NMOSFETs, however this is not meant to be limiting in any way. Driving arrangement 90 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single optional additional LED LFIX is illustrated, however this is not meant to be limiting in any way, and a plurality of additional LEDs may be inserted serially connected to additional LED LFIX without exceeding the scope. Driving arrangement 90 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope.

The phase side of source of AC power 20 is connected the input of dimmer 15 and the output of dimmer 15 is connected to a first input of full-wave rectifier 25. The neutral side of source of AC power 20 is connected to a second input of full-wave rectifier 25. The negative output of full-wave rectifier 25 is connected to a common point. The positive output of full-wave rectifier 25 is connected to the input of control unit 30 and to one end of current source 50, and the second end of current source 50 is connected to the anode of LED LFIX. The voltage at the positive output of full-wave rectifier 25 is denoted VLEDSTRING and the current driven by current source 50 and thus entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and to the drain of electronically controlled switch M1. The cathode of LED L1 is connected to the anode of LED L2 and to the drain of electronically controlled switch M2. The cathode of LED L2 is connected to the anode of LED L3 and to the drain of electronically controlled switch M3. The cathode of LED L3 is connected to the anode of LED LN and to the drain of electronically controlled switch MN. The cathode of LED LN is connected to the common point. The sources of each of electronically controlled switches M1, M2, M3 . . . MN are connected to the common point. The gate of each of electronically controlled switches M1, M2, M3 . . . MN is connected to a respective output of control unit 30. Control unit 30 is further connected to the common point.

In operation, driving arrangement 90 operates in all respects similar to driving arrangement 10 of FIG. 1, with the exception that each electronically controlled switch when closed bypasses all LEDs further on in the serial string. This is advantageous in that the $RDS_{on}$ of the electronically controlled switches below the closed electronically controlled switch need not be accounted for. Such an arrangement simplifies the operation of control unit 30 and the selection of electronically controlled switches M1, M2, M3 . . . MN.

Figure 2B:
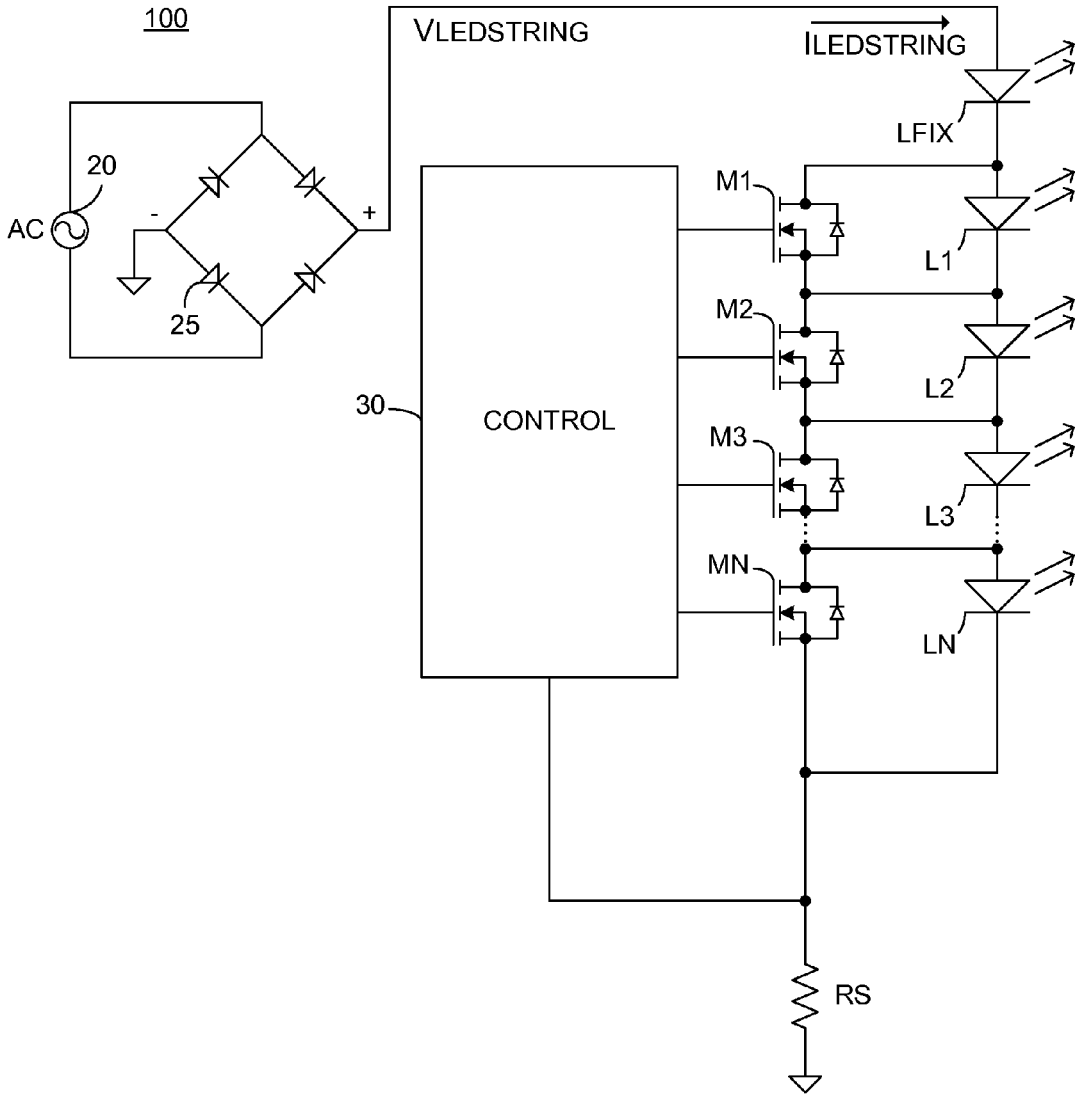
FIG. 2B illustrates a high level schematic diagram of a driving arrangement comprising a current sensor and a control unit, the driving arrangement coupled to a rectified AC voltage source according to an exemplary embodiment.

FIG. 2B illustrates a high level schematic diagram of a driving arrangement 100 according to an exemplary embodiment comprising: a source of AC power 20; a full-wave rectifier 25; a control unit 30; a plurality of LEDs L1, L2, L3 . . . LN; a plurality of electronically controlled switches M1, M2, M3 . . . MN, each associated with a particular light emitting diode L1, L2, L3 . . . LN; an optional additional LED LFIX; and a sense resistor RS. In one embodiment each of the electronically controlled switches M1, M2, M3 . . . MN are implemented as FETs, and are illustrated as NMOSFETs, however this is not meant to be limiting in any way. Driving arrangement 100 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single additional LED LFIX is illustrated, however this is not meant to be limiting in any way, and a plurality of additional LEDs may be inserted serially connected to additional LED LFIX without exceeding the scope. Driving arrangement 100 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to the anode of LED LFIX, and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and to the drain of electronically controlled switch M1. The cathode of LED L1 is connected to the anode of LED L2, to the source of electronically controlled switch M1 and to the drain of electronically controlled switch M2. The cathode of LED L2 is connected to the anode of LED L3, to the source of electronically controlled switch M2 and to the drain of electronically controlled switch M3. The cathode of LED L3 is connected to the anode of LED LN, the source of electronically controlled switch M3 and the drain of electronically controlled switch MN. The cathode of LED LN is connected to the source of electronically controlled switch MN, a first end of sense resistor RS, and the input of control unit 30. The gate of each of electronically controlled switches M1, M2, M3 . . . MN is connected to a respective output of control unit 30. A second end of sense resistor RS is connected to the common point.

In operation, each of electronically controlled switches M1, M2, M3 . . . MN is initially set to be closed, so that current ILEDSTRING flows through the serial path presented by closed electronically controlled switches M1, M2, M3 . . . MN and bypasses plurality of LEDs L1, L2, L3 . . . LN. Current ILEDSTRING then flows through sense resistor RS, and a voltage representation of the current is received at control unit 30. Responsive to the received voltage, control unit 30 selectively opens or closes certain ones of electronically controlled switches M1, M2, M3 . . . MN. LEDs for which the associated electronically controlled switch is closed, are bypassed and do not provide illumination, while LEDs for which the associated electronically controlled switch is open experience current flow there through with a resultant illumination.

In further detail, as VLEDSTRING rises above the voltage drop of additional LED LFIX, current initially flows through additional LED LFIX, through closed electronically controlled switches M1, M2, M3 . . . MN, and through sense resistor RS. The amount of current is in one embodiment limited by sense resistor RS, which is set to a value exhibiting a non-negligible load. In another embodiment, one of electronically controlled switches M1, M2, M3 . . . MN is set to exhibit a non-negligible $RDS_{on}$, thereby limiting the current flow. As current through sense resistor RS increases, responsive to the increasing voltage VLEDSTRING, control unit 30 senses the increasing voltage drop across sense resistor RS, and when the increasing voltage drop reaches a predetermined level, control unit 30 opens one of electronically controlled switches M1, M2, M3 . . . MN. In the embodiment in which one of electronically controlled switches M1, M2, M3 . . . MN is set to exhibit a non-negligible $RDS_{on}$, a first one of electronically controlled switches M1, M2, M3 . . . MN is opened and a second one is set to exhibit a non-negligible $RDS_{on}$.

Current ILEDSTRING thus flows through additional LED LFIX and one of LEDs L1, L2, L3 . . . LN. As the voltage drop across sense resistor RS rises, control unit 30 opens a second one of electronically controlled switches M1, M2, M3 . . . MN. In the embodiment in which one of electronically controlled switches M1, M2, M3 . . . MN is set to exhibit a non-negligible $RDS_{on}$, a second one of electronically controlled switches M1, M2, M3 . . . MN is opened and a third one is set to exhibit a non-negligible $RDS_{on}$. In the event that the voltage drop across sense resistor RS falls to below a predetermined level, control unit 30 opens one of the closed electronically controlled switches M1, M2, M3 . . . MN.

Referring back to an event in which voltage VLEDSTRING continues to rise, current ILEDSTRING thus flows through additional LED LFIX and two of LEDs L1, L2, L3 . . . LN. As the voltage drop across sense resistor RS rises, control unit 30 opens a third one of electronically controlled switches M1, M2, M3 . . . MN. In the embodiment in which one of electronically controlled switches M1, M2, M3 . . . MN is set to exhibit a non-negligible $RDS_{on}$, a third one of electronically controlled switches M1, M2, M3 . . . MN is opened and a fourth one is set to exhibit a non-negligible $RDS_{on}$. In the event that the voltage drop across sense resistor RS falls to below a predetermined level, control unit 30 opens one of the closed electronically controlled switches M1, M2, M3 . . . MN.

Referring back to an event in which voltage VLEDSTRING continues to rise, current ILEDSTRING thus flows through additional LED LFIX and three of LEDs L1, L2, L3 . . . LN. As the voltage drop across sense resistor RS rises, control unit 30 opens a fourth one of electronically controlled switches M1, M2, M3 . . . MN, and current ILEDSTRING thus flows through all of LEDs L1, L2, L3 . . . LN. In the event that the voltage drop across sense resistor RS falls to below a predetermined level, control unit 30 opens one of the closed electronically controlled switches M1, M2, M3 . . . MN.

Thus, driving arrangement 100 provides illumination consonant with the instantaneous value of voltage VLEDSTRING, by opening the requisite number of electronically controlled switches M1, M2, M3 . . . MN thus enabling current flow, and voltage drop, across the associated respective LED L1, L2, L3 . . . LN.

Figure 2C:
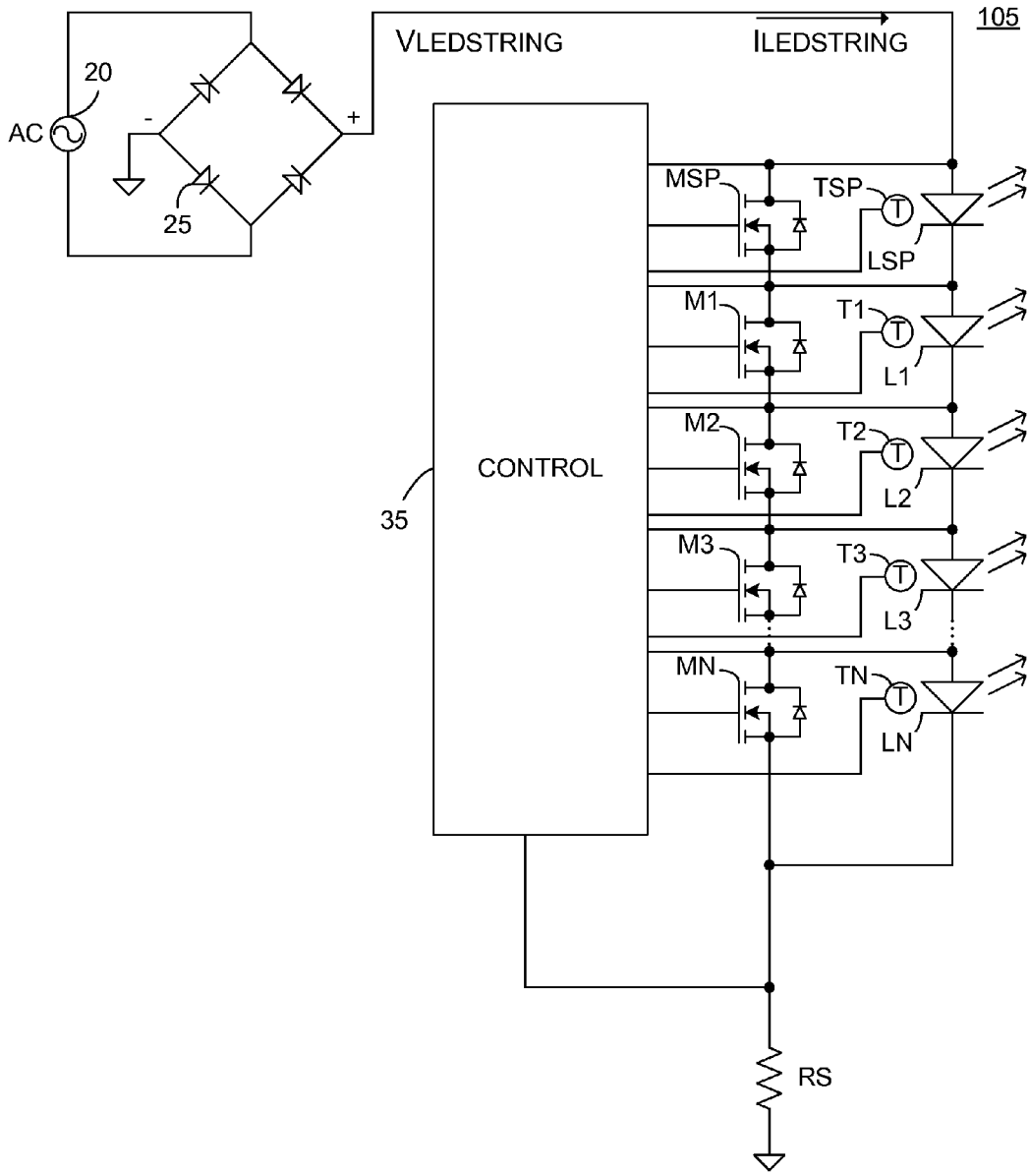
FIG. 2C illustrates a high level schematic diagram of a driving arrangement comprising a control unit, and a plurality of LEDs each with an associated thermal sensor.

FIG. 2C illustrates a high level schematic diagram of a driving arrangement 105 according to an exemplary embodiment comprising: a source of AC power 20; a full-wave rectifier 25; a control unit 35; a plurality of LEDs L1, L2, L3 . . . LN; at least one spare LED LSP; a plurality of thermal sensors TSP, T1, T2, T3 . . . TN, each associated with a particular one of LEDs L1, L2, L3 . . . LN and spare LED TSP; a plurality of electronically controlled switches MSP, M1, M2, M3 . . . MN, each associated with a particular one of LEDs L1, L2, L3 . . . LN and spare LED(s) LSP; and a sense resistor RS. In particular, for each spare LED LSP a particular electronically controlled switch MSP is provided. In one embodiment each of the electronically controlled switches MSP, M1, M2, M3 . . . MN are implemented as FETs, and are illustrated as NMOSFETs, however this is not meant to be limiting in any way. Driving arrangement 105 is illustrated in relation to 4 serially connected LEDs and a single spare LED, however this is not meant to be limiting in any way, and additional LEDs may be serially connected, with an associated electronically controlled switch, between LED L3 and LED LN, without exceeding the scope. Similarly, a single spare LED LSP is illustrated, however this is not meant to be limiting in any way, and a plurality of spare LEDs may be inserted serially connected to spare LED LSP, each with an associated thermal sensor and electronically controlled switch without exceeding the scope. Driving arrangement 105 may be provided with fewer than 4 serially connected LEDs without exceeding the scope. Each of spare LED LSP and LEDs L1-LN may be provided with an internal protection breakdown diode arranged to allow current flow there through in the event of failure without exceeding the scope.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to the anode of spare LED LSP, to the drain of electronically controlled switch MSP, and to a respective input of control unit 35 and the voltage at the output is denoted VLEDSTRING. The current entering the parallel node shared by the anode of spare LED LSP and the drain of electronically controlled switch MSP is denoted ILEDSTRING. Optionally, a capacitor may be provided across the outputs of full-wave rectifier 25 reducing the voltage ripple, and preventing a drop out voltage at which no LEDs are lit.

The cathode of spare LED LSP is connected to the anode of LED L1, to the source of electronically controlled switch MSP, to the drain of electronically controlled switch M1 and to a respective input of control unit 35. The cathode of LED L1 is connected to the anode of LED L2, to the source of electronically controlled switch M1, to the drain of electronically controlled switch M2 and to a respective input of control unit 35. The cathode of LED L2 is connected to the anode of LED L3, to the source of electronically controlled switch M2, to the drain of electronically controlled switch M3 and to a respective input of control unit 35. The cathode of LED L3 is connected to the anode of LED LN, the source of electronically controlled switch M3, the drain of electronically controlled switch MN and to a respective input of control unit 35. The cathode of LED LN is connected to the source of electronically controlled switch MN, a first end of sense resistor RS, and to a respective input of control unit 35. The gate of each of electronically controlled switches MSP, M1, M2, M3 . . . MN is connected to a respective output of control unit 35. Each thermal sensor TSP, T1, T2, T3 . . . TN is arranged to be in proximity with the respective associated LED L1, L2, L3 . . . LN and spare LED TSP. The output of each thermal sensor TSP, T1, T2, T3 . . . TN is connected to a respective input of control unit 35. A second end of sense resistor RS is connected to the common point.

The number of LEDs L1, L2, L3 . . . LN is preferably selected such that when VLEDSTRING is at the maximum voltage all of LEDs L1, L2, L3 . . . LN are illuminated, however the voltage drop across sense resistor RS is less than the required voltage drop to illuminate spare LED LSP.

In operation, driving arrangement 105 is in all respects similar to the operation of driving arrangement 100 with the exception that control unit 35 is further operative to monitor the temperature of each LED via the respective associated temperature sensor T1, T2, T3 . . . TN, and further monitor the voltage of an electric characteristic associated with the respective LEDs LSP, L1, L2, L3 . . . LN. In one embodiment, as illustrated, the voltage drop across each LED is available via respective connections to the cathode and anode of the LED at inputs of control unit 35. In another embodiment, in which connection across each LED is not provided, the condition across each LED is determined according to the teachings of the prior art, including without limitation: U.S. Patent Application Publication S/N 2007/0159750 A1 published to Peker et al Jul. 12, 2007, and U.S. Patent Application Publication S/N 2005/0231459 A1 published to Furukawa Apr. 15, 2005, the entire contents of both of which are incorporated herein by reference. In one non-limiting example, responsive to a drop in current through sense resistor RS, the failed LED is isolated by closing one electronically controlled switch at a time to create a bypass condition, until the failed LED is detected.

In the event that the temperature of a particular one of LEDs L1, L2, L3 . . . LN, rises above a predetermined value, the electronically controlled switch associated with the LED exhibiting the increased temperature is closed, bypassing the LED exhibiting the increased temperature, and a spare LED LSP is activated in its place, particularly by opening the electronically controlled switch MSP associated with spare LED LSP, and controlling the electronically controlled switch MSP in accordance with the algorithm used to control the now bypassed LED exhibiting the increased temperature.

In the event that a particular one of LEDs L1, L2, L3 . . . LN exhibits a short circuit, detected as described above, a spare LED LSP is activated in its place, particularly by opening the electronically controlled switch MSP associated with spare LED LSP, and controlling the electronically controlled switch MSP in accordance with the algorithm used to control the now short circuited LED. Preferably, the electronically controlled switch associated with the now short circuited LED is closed to ensure that any intermittent behavior does not interfere with the operation of driving arrangement 105.

In the event that a particular one of LEDs L1, L2, L3 . . . LN exhibits an open condition, detected as described above, the electronically controlled switch associated with the LED exhibiting the open condition is closed, bypassing the LED exhibiting the open condition, and a spare LED LSP is activated in its place, particularly by opening the electronically controlled switch MSP associated with spare LED LSP, and controlling the electronically controlled switch MSP in accordance with the algorithm used to control the now bypassed open LED.

Thus, driving arrangement 105 provides for continuous illumination of a predetermined value responsive to the input voltage irrespective of any LEDs exhibiting an open condition, short condition, or excessive heating.

Figure 2D:
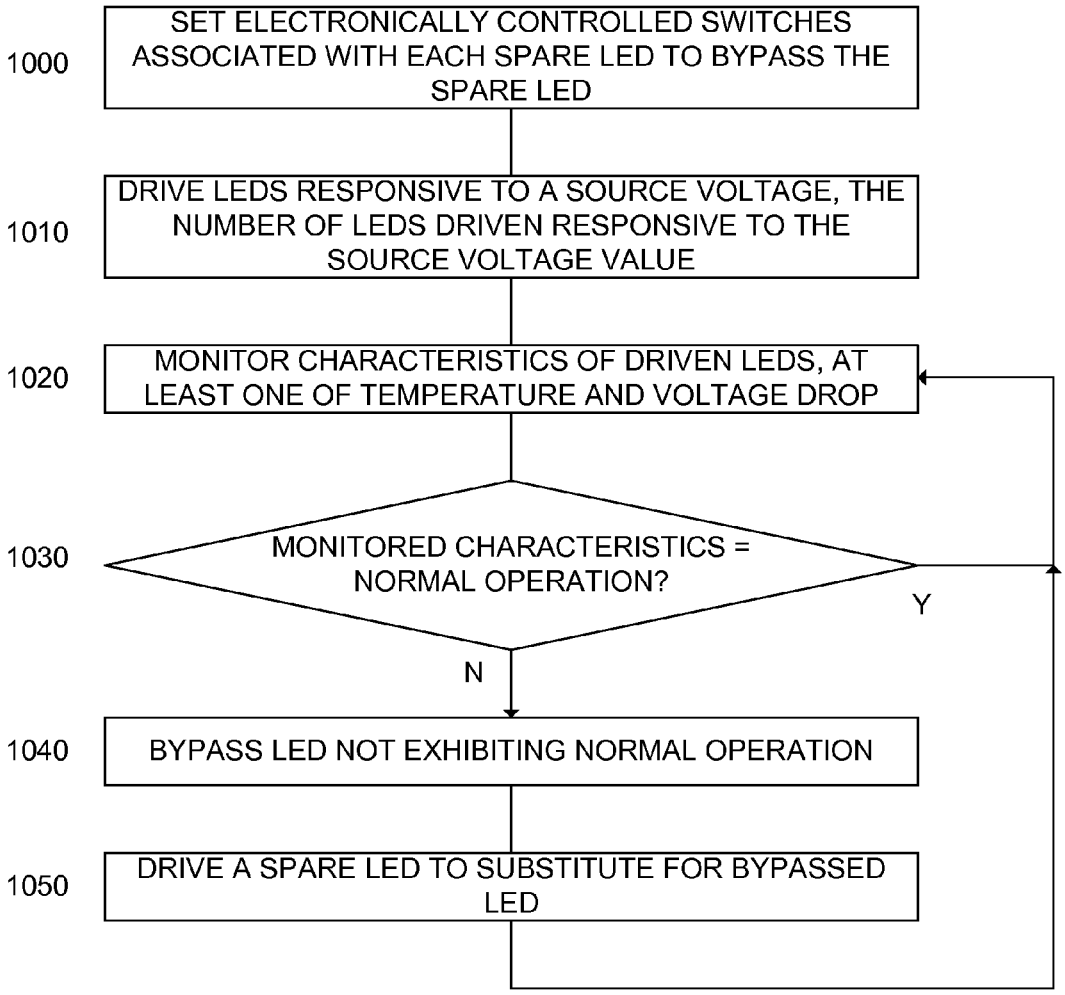
FIG. 2D illustrates a high level flow chart of a method of the control unit of FIG. 2C.

FIG. 2D illustrates a high level flow chart of the method of operation of control unit 35 of FIG. 2C to monitor and bypass any abnormal LED. In stage 1000, the electronically controlled switches MSP associated with each spare LED LSP are closed to thereby bypass the spare LEDs LSP. In stage 1010, LEDs L1, L2, L3 . . . LN are driven with ILEDSTRING responsive to the source voltage VLEDSTRING, with the number of LEDs driven being responsive the instantaneous value of VLEDSTRING. In stage 1020, characteristics of the driven LEDs of stage 1010 are monitored, the characteristics comprising at least one of the temperature associated with the driven LED L1, L2, L3 . . . LN and the voltage drop across the driven LED L1, L2, L3 . . . LN.

In stage 1030, the monitored characteristics of stage 1020 are checked to determine if the driven LED is within a predetermined range associated with normal operation. In one embodiment, temperature of the LED less than a predetermined value is considered normal operation. In one embodiment a voltage drop across the LED within a predetermined range is considered normal operation. In the event that the monitored characteristics of each of the driven LEDs are within normal operation, stage 1020 as described above is performed.

In the event that in stage 1030 the monitored characteristics of any one of the driven LEDs is not consonant with normal operation, in stage 1040, the LED not consonant with normal operation is bypassed by closing the associated electronically controlled switch. In stage 1050, a spare LED LSP is driven to substitute for the bypassed LED, and stage 1020 as described above is performed. The term substitute as used herein comprises controlling the associated electronically controlled switch MSP in cooperation with spare LED LSP in the manner described above in relation to electronically controlled switches M1, M2, M3 . . . MN.

Figure 3A:
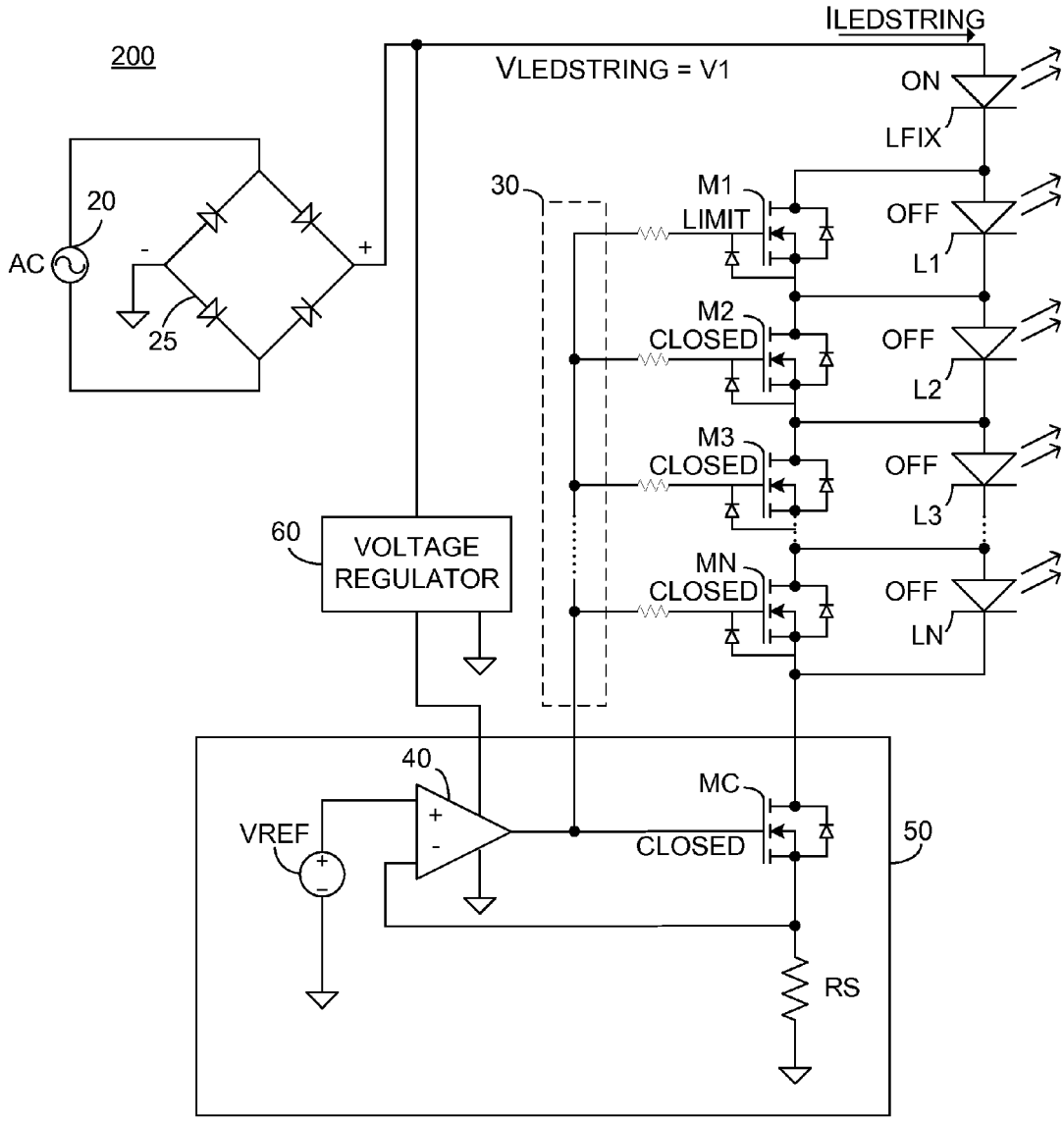
FIG. 3A illustrates a high level schematic diagram of a driving arrangement coupled to a rectified AC voltage source, showing operation of the driving arrangement at a first voltage level output by the rectified voltage source.
Figure 3B:
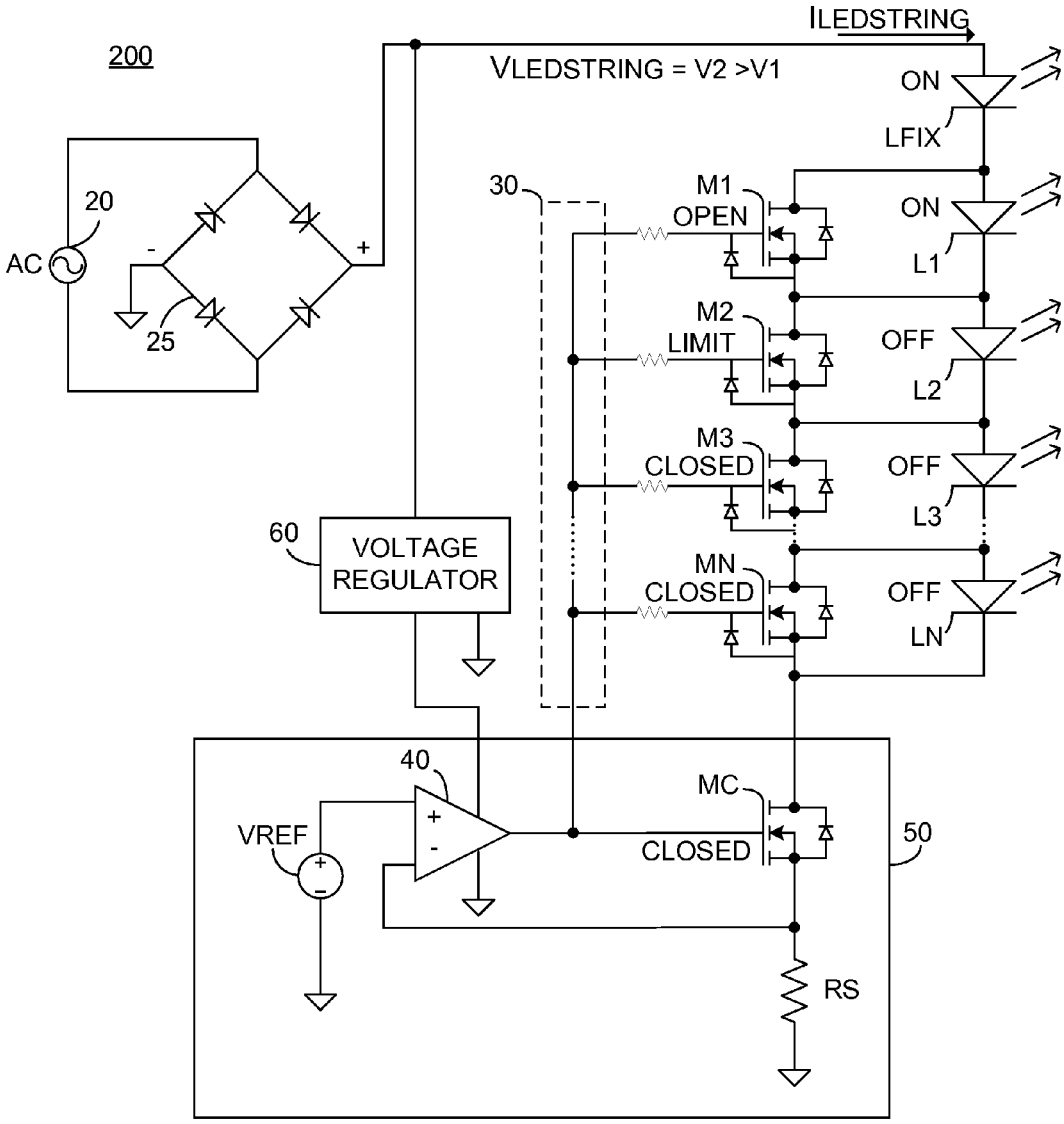
FIG. 3B illustrates a high level schematic diagram of a driving arrangement coupled to a rectified AC voltage source, showing operation of the driving arrangement at a second voltage level, greater than the first voltage level, output by the rectified voltage source.
Figure 3C:
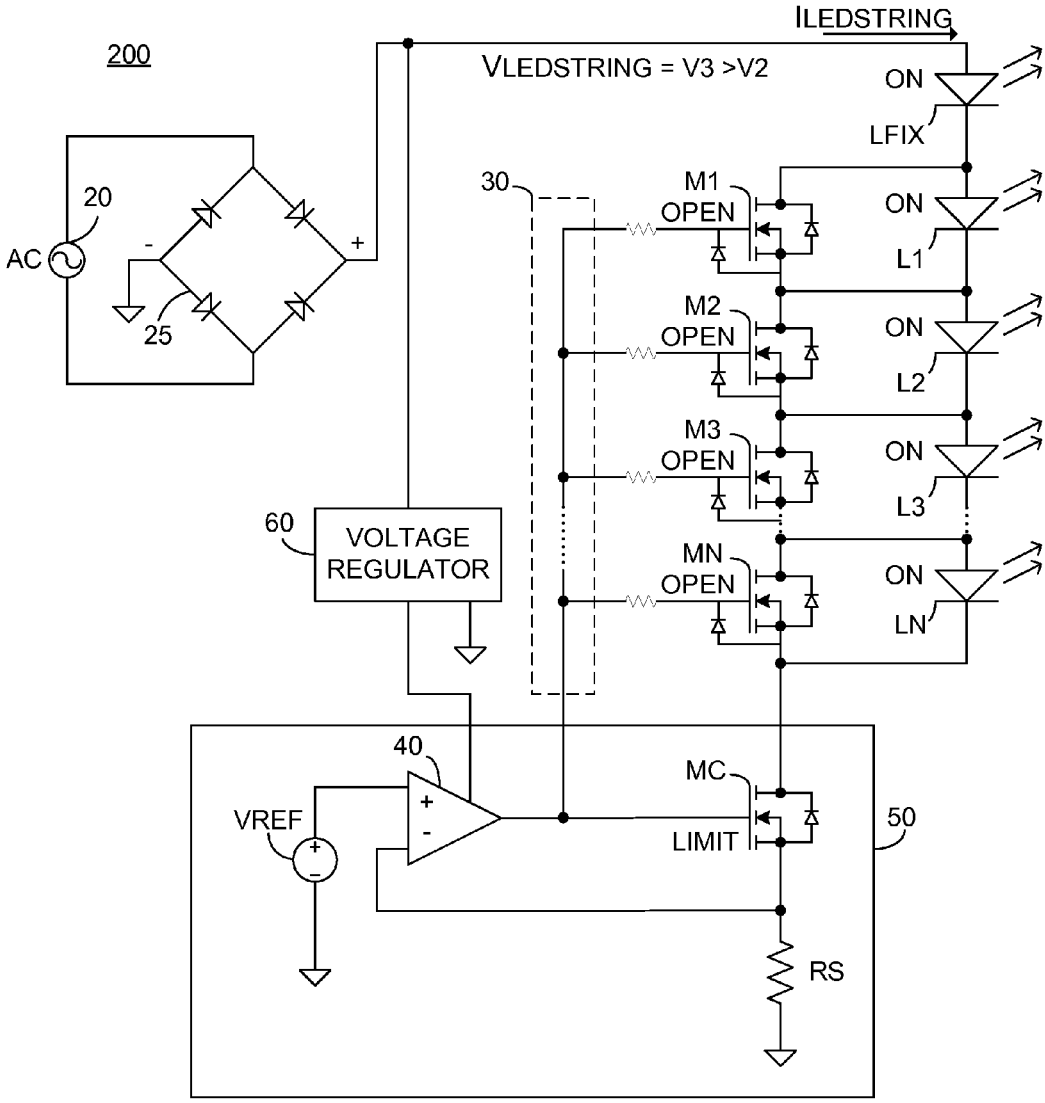
FIG. 3C illustrates a high level schematic diagram of a driving arrangement coupled to a rectified AC voltage source, showing operation of the driving arrangement at a third voltage level, greater than the second voltage level, output by the rectified voltage source.

FIGS. 3A-3C illustrate a high level schematic diagram of the operation of a driving arrangement 200 according to an exemplary embodiment at varying voltage levels output by a rectified voltage source. Driving arrangement 200 comprises: a source of AC power 20; a full-wave rectifier 25; a plurality of LEDs L1, L2, L3 . . . LN; a plurality of electronically controlled switches M1, M2, M3 . . . MN, each associated with a particular light emitting diode L1, L2, L3 . . . LN; an optional additional LED LFIX; a control unit 30 constituted of a common connection to the gates of electronically controlled switches M1, M2, M3 . . . MN; a current source 50; and a voltage regulator 60. Current source 50 comprises an electronically controlled switch MC, a sense resistor RS, a fixed reference voltage VREF and a differential amplifier 40. In one embodiment each of the electronically controlled switches MC, M1, M2, M3 . . . MN are implemented as FETs, and are illustrated as NMOSFETs, however this is not meant to be limiting in any way. Driving arrangement 200 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single additional LED LFIX is illustrated, however this is not meant to be limiting in any way, and a plurality of additional LEDs may be inserted serially connected to additional LED LFIX without exceeding the scope. Driving arrangement 200 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope. Electronically controlled switches M1, M2, M3 . . . MN and MC are preferably all nearly identical, exhibiting matched properties.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to the input of voltage regulator 60 and to the anode of LED LFIX, and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and the drain of electronically controlled switch M1. The cathode of LED L1 is connected to the anode of LED L2, to the source of electronically controlled switch M1 and to the drain of electronically controlled switch M2. The cathode of LED L2 is connected to the anode of LED L3, to the source of electronically controlled switch M2 and to the drain of electronically controlled switch M3. The cathode of LED L3 is connected to the anode of LED LN, to the source of electronically controlled switch M3 and to the drain of electronically controlled switch MN. The cathode of LED LN is connected to the source of electronically controlled switch MN and the drain of electronically controlled switch MC. The gate of each of electronically controlled switches M1, M2, M3 . . . MN are connected together via the input of control unit 30 to the gate of electronically controlled switch MC and the output of differential amplifier 40. The source of electronically controlled switch MC is connected to a first end of sense resistor RS and the inverting input of differential amplifier 40, and a second end of sense resistor RS is connected to the common point. The non-inverting input of differential amplifier 40 is connected to the positive output of fixed reference voltage VREF. The output of voltage regulator 60 is connected to the positive power input of differential amplifier 40.

Each of electronically controlled switches M1, M2, M3 . . . MN further exhibits a protection circuitry implemented in a non-limiting manner as a diode, whose anode is connected to the drain of the respective electronically controlled switch and whose cathode is connected to the gate of the respective electronically controlled switch, and a resistor between the gate of the electronically controlled switch and the output of differential amplifier 40. The protection circuitry is operative to insure that the source voltage does not exceed the gate voltage by more than a predetermined amount.

Referring to FIG. 3A, in operation voltage VLEDSTRING is at voltage V1, which is sufficient to light additional LED LFIX. Each of electronically controlled switches M1, M2, M3 . . . MN is initially set to be closed, since in the absence of any current flow differential amplifier 40 drives the gates of electronically controlled switches M1, M2, M3 . . . MN and MC towards the supply value output by voltage regulator 60 and, as such, the gate-source voltage of each electronically controlled switch is greater than the voltage threshold of the constituent MOSFET. Provided voltage V1 is greater than the voltage drop of additional LED LFIX, therefore current ILEDSTRING flows through LED LFIX and the serial path presented by closed electronically controlled switches M1, M2, M3 . . . MN and bypasses plurality of LEDs L1, L2, L3 . . . LN. Current source 50 is operative to control current ILEDSTRING to be at a desired level, as will be described further hereinto below.

The gate voltage of electronically controlled switch M1, driven towards the voltage output by voltage regulator 60, via control unit 30, is greater than the source voltage of electronically controlled switch M1 by a value greater than the voltage threshold of the constituent MOSFET, and thus electronically controlled switch M1 is closed and current ILEDSTRING bypasses LED L1 through electronically controlled switch M1. The source voltage of electronically controlled switch M2 is lower than the source voltage of electronically controlled switch M1, due to the voltage drop across electronically controlled switch M2. Similarly, the source voltage of each of electronically controlled switches M3 . . . MN is lower than the source voltage of the electronically controlled switch connected to its drain. Electronically controlled switch MC is similarly closed, thereby current ILEDSTRING flows through the electronically controlled switch MC and through sense resistor RS. Differential amplifier 40 compares the voltage drop across sense resistor RS with fixed reference voltage VREF. In the event that the voltage drop across sense resistor RS is less than the value of fixed reference voltage VREF, the output of differential amplifier 40 is driven towards the positive supply rail of differential amplifier 40, and electronically controlled switch M1 is driven to be fully closed, i.e. exhibits a minimum $RDS_{on}$. As the voltage drop across sense resistor RS increases and approaches fixed reference voltage VREF, the output of differential amplifier 40 decreases towards zero. Since the source voltage of electronically controlled switch M1 is greater than the source voltage of any of electronically controlled switches M2, M3 . . . MN and MC, the channel resistance of electronically controlled switch M1 increases so as to limit the current through sense resistor RS to not exceed the value represented by fixed reference voltage VREF. Electronically controlled switch M1 thus acts as a current limiter.

In FIG. 3B voltage VLEDSTRING rises to a voltage level V2, greater than voltage V1, at least equal to the voltage drop of LED L1 and additional LED LFIX when conducting current. At voltage level V2, the voltage drop across electronically controlled switch M1, which as described above has been limiting current ILEDSTRING to the value represented by VREF, reaches the minimal operating voltage drop across LED L1, and current begins to flow there through. The source voltage of electronically controlled switch M1 then rises to V2 minus the voltage drops of additional LED LFIX and LED L1, and as a result the gate-source voltage no longer exceeds the threshold voltage of electronically controlled switch M1, thereby opening electronically controlled switch M1. As described above in relation to FIG. 3A, current is now limited by electronically controlled switch M2.

The process described above in relation to FIGS. 3A and 3B is repeated until in FIG. 3C voltage VLEDSTRING rises to a voltage level V3, greater than voltage V2, at least equal to the voltage drop of LEDs L1, L2, L3 . . . LN and additional LED LFIX when conducting current. At voltage level V3, all of electronically controlled switches M1, M2, M3 . . . MN are fully open, current ILEDSTRING flows through the serial path represented by additional LED LFIX, LEDs L1, L2, L3 . . . LN, and through current source 50. Current is limited by electronically controlled switch MC, responsive to the output of differential amplifier 40 so as to ensure that current ILEDSTRING is consonant with the value of fixed reference voltage VREF. It is to be understood that the value of fixed reference voltage VREF may be modified, thereby adjusting the amount of current ILEDSTRING.

FIGS. 3A-3C have been described in an environment in which voltage VLEDSTRING is increasing. When voltage VLEDSTRING is decreasing, the voltage drop across sense resistor RS is reduced, thereby increasing the output of differential amplifier 40. The gate voltage of each of electronically controlled switches M1, M2, M3 . . . MN and MC increases, thereby reducing the channel resistance of the electronically controlled switch currently limiting the current. As the available voltage drops, the LED whose cathode is connected to the drain of the limiting electronically controlled switch fails to receive sufficient operating voltage. The electronically controlled switch currently limiting the current reduces its channel resistance as the falling voltage VLEDSTRING is reflected in an increased gate-source voltage and the channel resistance of the electronically controlled switch serially adjacent thereto, and closer to the source of voltage VLEDSTRING, begins to rise. For example, if in FIG. 3B voltage VLEDSTRING begins to decrease, electronically controlled switch M2 closes completely and the channel resistance of electronically controlled switch M1 rises. LED L1 fails to receive sufficient operating voltage and current begins to flow through electronically controlled switch M1, which now acts as a current limiter, as described above in relation to FIG. 3A.

Figure 4:
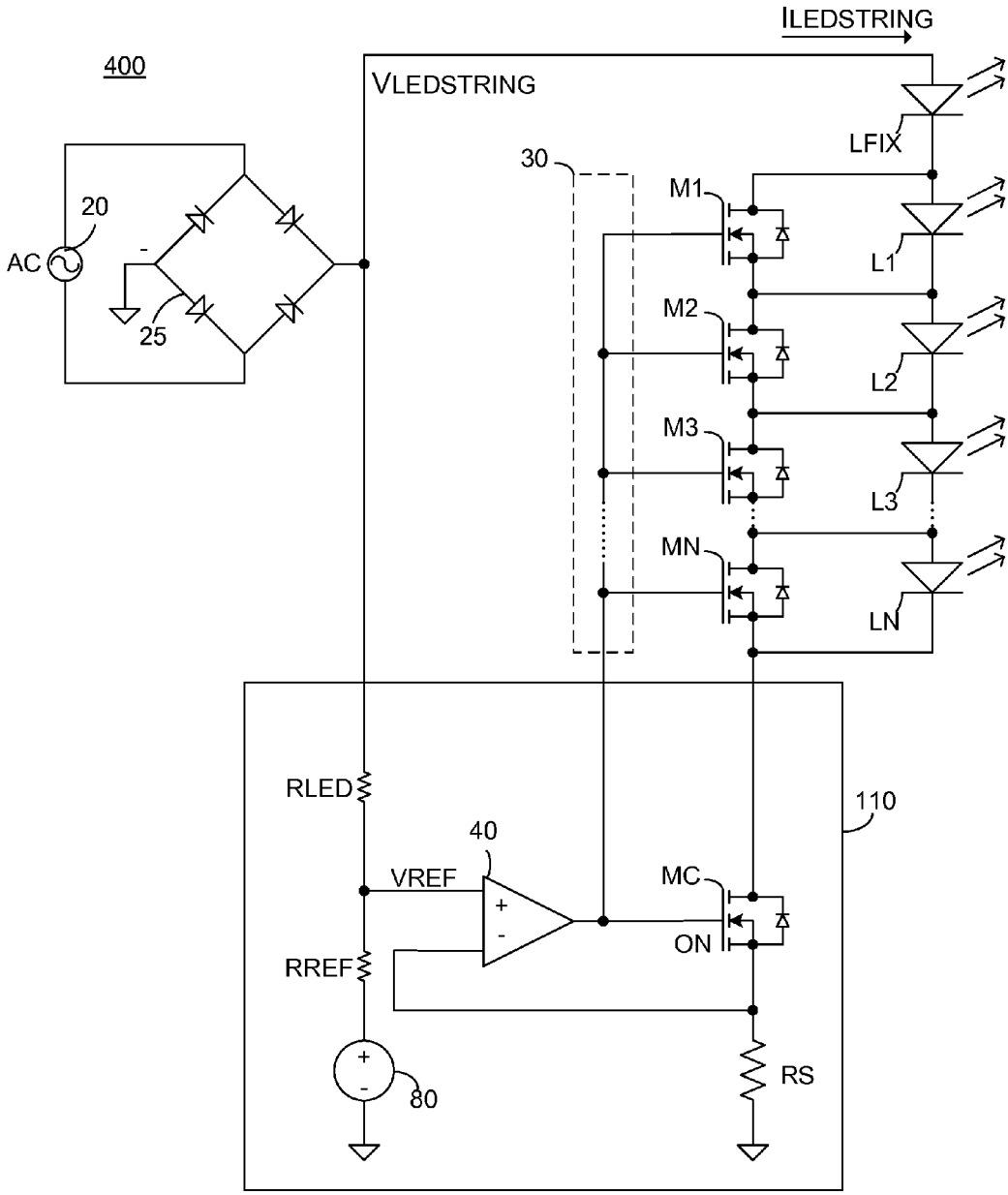
FIG. 4 illustrates a high level schematic diagram of a second driving arrangement coupled to a rectified AC voltage source according to an exemplary embodiment, in which the current through the serially connected LEDs at least partially follows the voltage waveform.

FIG. 4 illustrates a high level schematic diagram of a driving arrangement 400 comprising a source of AC power 20; a full-wave rectifier 25; a plurality of LEDs L1, L2, L3 . . . LN; an optional additional LED LFIX; a plurality of electronically controlled switches M1, M2, M3 . . . MN, each associated with a particular light emitting diode L1, L2, L3 . . . LN; a control unit 30 constituted of a common connection to the gates of electronically controlled switches M1, M2, M3 . . . MN; and a controlled current source 110. Controlled current source 110 comprises an electronically controlled switch MC, a sense resistor RS, a differential amplifier 40, a fixed voltage source 80, and a pair of resistors RREF and RLED, which form a voltage divider. In one embodiment each of the electronically controlled switches MC, M1, M2, M3 . . . MN are implemented as FETs, and are illustrated as NMOSFETs, however this is not meant to be limiting in any way. Driving arrangement 400 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single additional LED LFIX is illustrated, however this is not meant to be limiting in any way, and a plurality of additional LEDs may be inserted serially connected to additional LED LFIX without exceeding the scope. Driving arrangement 400 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope. Electronically controlled switches M1, M2, M3 . . . MN and MC are preferably all nearly identical, exhibiting matched properties.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to a first end of resistor RLED and to the anode of additional LED LFIX and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and the drain of electronically controlled switch M1. The cathode of LED L1 is connected to the anode of LED L2, the source of electronically controlled switch M1 and the drain of electronically controlled switch M2. The cathode of LED L2 is connected to the anode of LED L3, the source of electronically controlled switch M2 and the drain of electronically controlled switch M3. The cathode of LED L3 is connected to the anode of LED LN, the source of electronically controlled switch M3 and the drain of electronically controlled switch MN. The cathode of LED LN is connected to the source of electronically controlled switch MN and the drain of electronically controlled switch MC. The gate of each of plurality of electronically controlled switches M1, M2, M3, MN and MC is connected to the output of differential amplifier 40. The source of electronically controlled switch MC is connected to a first end of sense resistor RS and the inverting input of differential amplifier 40, and the gate of electronically controlled switch MC is connected to the output of differential amplifier 40. A second end of sense resistor RS is connected to the common point. The non-inverting input of differential amplifier 40 is connected to a first end of resistor RREF and a second end of resistor RLED, the voltage at that point being denoted VREF. A second end of resistor RREF is connected to fixed voltage source 80.

In operation driving arrangement 400 operates in all respects similar to driving arrangement 200 of FIGS. 3A-3C, with the exception that voltage VREF is a function of voltage VLEDSTRING. As a result, as VLEDSTRING increases the current through sense resistor RS increases, and as VLEDSTRING decreases the current through sense resistor RS decreases. Thus, current ILEDSTRING changes as a function of voltage VLEDSTRING.

Figure 5A:
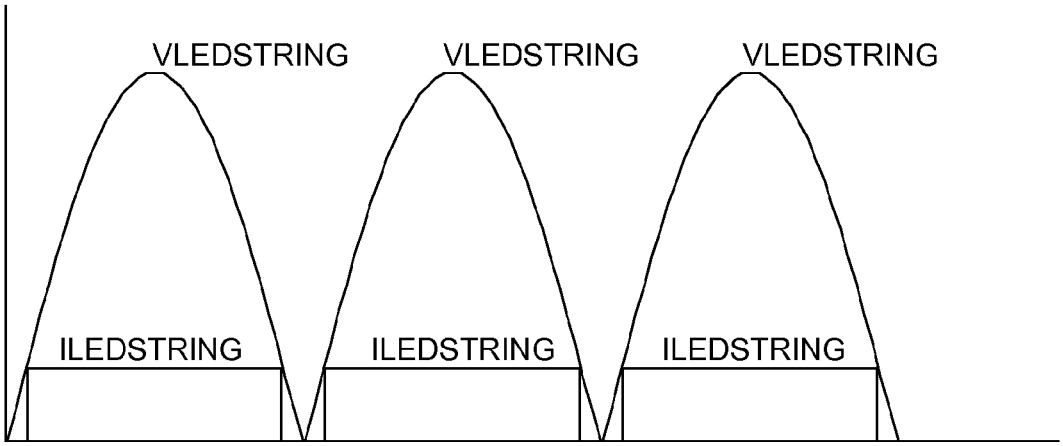
FIG. 5A illustrates a graph of the voltage and current through the serially connected LEDs of the driving arrangements of FIGS. 3A-3C as a function of time.

FIG. 5A illustrates a graph of the voltage and current through the serially connected LEDs of the driving arrangements of FIGS. 3A-3C as a function of time, where the x-axis represents time and the y-axis represents amplitude. Voltage VLEDSTRING and current ILEDSTRING of FIGS. 3A-3C are shown. As described above in relation to FIGS. 3A-3C, as voltage VLEDSTRING increases and decreases, provided that VLEDSTRING is a above a minimum voltage sufficient to light additional LED LFIX, and sufficient to provide an operating voltage across the string of electronically controlled switches M1, M2, M3 . . . MN, and MC, differential amplifier 40 is operative to maintain a desired current ILEDSTRING set by the value of fixed reference voltage VREF.

Figure 5B:
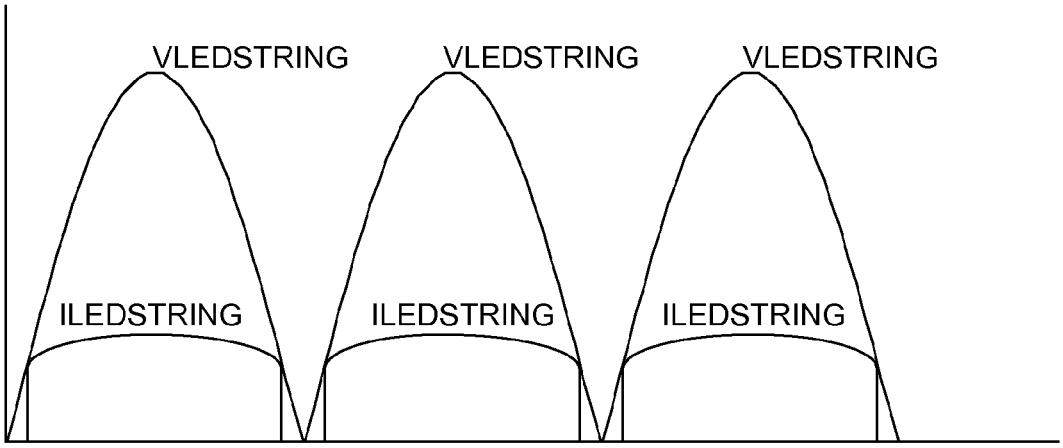
FIG. 5B illustrates a graph of the voltage and current through the serially connected LEDs of the driving arrangement of FIG. 4 as a function of time.

FIG. 5B illustrates a graph of the voltage and current through the serially connected LEDs of the driving arrangement of FIG. 4 as a function of time, where the x-axis represents time and the y-axis represents amplitude. Voltage VLEDSTRING and current ILEDSTRING of FIGS. 3A-3C are shown. As described above in relation to FIG. 4, as voltage VLEDSTRING increases and decreases differential amplifier 40 is operative to maintain a desired current ILEDSTRING, which is a function of VLEDSTRING. Having the current increase responsive to an increase in VLEDSTRING improves the power factor of driving arrangement 400 as compared to driving arrangement 200 of FIGS. 3A-3C.

Figure 6:
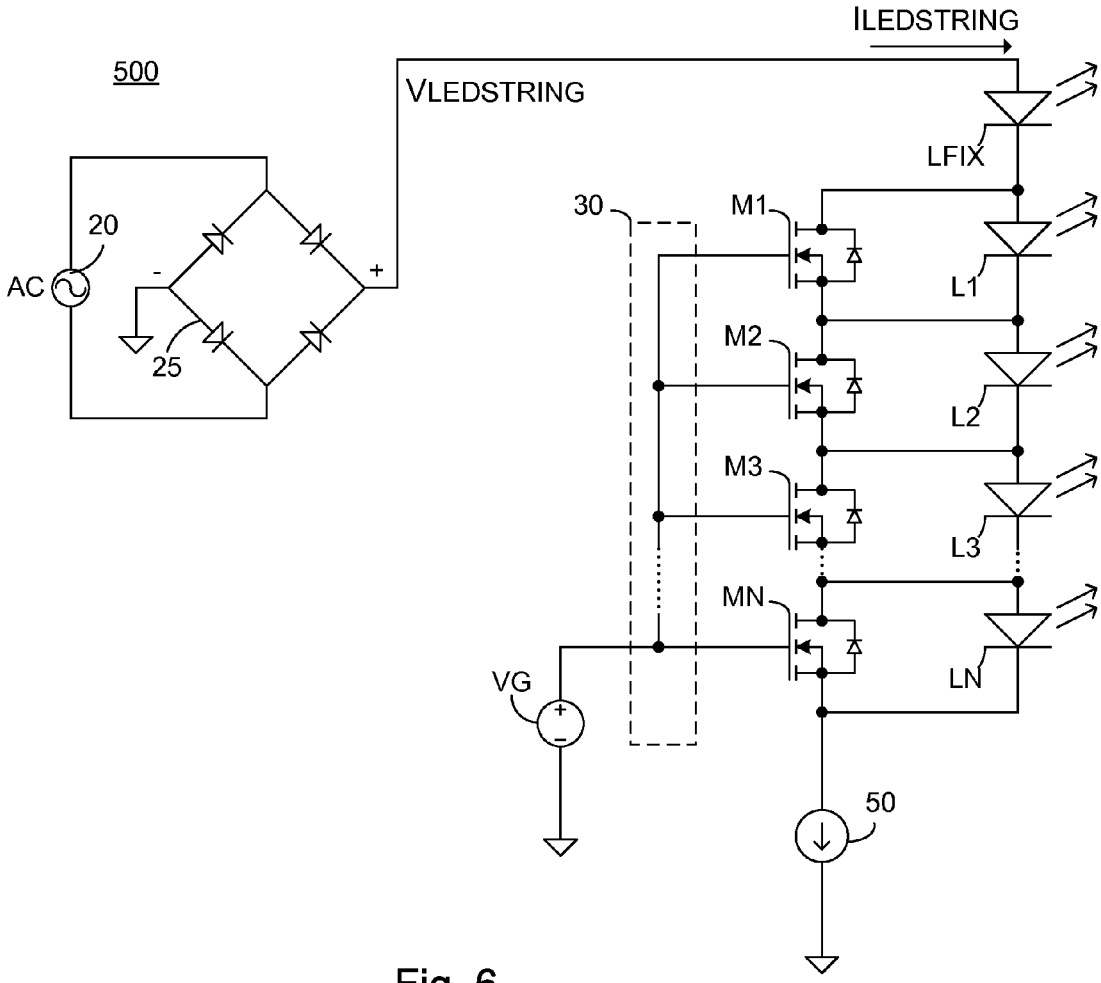
FIG. 6 illustrates a high level schematic diagram of a driving arrangement comprising a current source, wherein the control inputs of the plurality of electronically controlled switches are coupled to a fixed voltage point.

FIG. 6 illustrates a high level schematic diagram of a driving arrangement 500 comprising a source of AC power 20; a full-wave rectifier 25; a plurality of LEDs L1, L2, L3 . . . LN; an optional additional LED LFIX; a plurality of electronically controlled switches M1, M2, M3, MN, each associated with a particular light emitting diode L1, L2, L3 . . . LN; a control unit 30 constituted of a common connection to the gates of electronically controlled switches M1, M2, M3 . . . MN; a current source 120 and a fixed reference voltage VG. In one embodiment each of the electronically controlled switches MC, M1, M2, M3 . . . MN are implemented as FETs, and are illustrated as NMOSFETs, however this is not meant to be limiting in any way. Driving arrangement 500 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single additional LED LFIX is illustrated, however this is not meant to be limiting in any way, and a plurality of additional LEDs may be inserted serially connected to additional LED LFIX without exceeding the scope. Driving arrangement 500 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope. Electronically controlled switches M1, M2, M3 . . . MN and MC are preferably all nearly identical, exhibiting matched properties.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to the anode of LED LFIX and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and the drain of electronically controlled switch M1. The cathode of LED L1 is connected to the anode of LED L2, the source of electronically controlled switch M1 and the drain of electronically controlled switch M2. The cathode of LED L2 is connected to the anode of LED L3, the source of electronically controlled switch M2 and the drain of electronically controlled switch M3. The cathode of LED L3 is connected to the anode of LED LN, the source of electronically controlled switch M3 and the drain of electronically controlled switch MN. The cathode of LED LN is connected to the source of electronically controlled switch MN and current source 50. The gate of each of plurality of electronically controlled switches M1, M2, M3 . . . MN is commonly connected, via control unit 30, to fixed reference voltage VG, fixed reference voltage VG preferably being high enough such that in operation all of electronically controlled switches M1, M2, M3, . . . MN can be closed, i.e. the gate-source voltage of each of electronically controlled switches M1, M2, M3 . . . MN can become greater than the voltage threshold of the respective electronically controlled switch, as will be described below.

In operation, as described above in relation to driving arrangement 10 of FIG. 1, a full wave rectified version of the received AC signal, which may be phase controlled is received by the anode of additional LED LFIX. Each of electronically controlled switches M1, M2, M3 . . . MN is initially set to be closed, since the gate voltage of each of electronically controlled switches M1, M2, M3 . . . MN is equal to the output of fixed reference voltage VG and VLEDSTRING is at a minimal value. As VLEDSTRING rises above the voltage drop of additional LED LFIX, current initially flows through additional LED LFIX and through the serial path presented by closed electronically controlled switches M1, M2, M3 . . . MN and bypasses plurality of LEDs L1, L2, L3 . . . LN. The current flow is limited by the action of current source 50. As voltage VLEDSTRING rises the voltage at the source of electronically controlled switch M1 also rises since electronically controlled switch M1 is closed, until voltage VLEDSTRING rises to be equal to the value of the minimal operating voltage drop across LED L1 plus the voltage drop across additional LED LFIX, at which point LED L1 begins to conduct, bypassing electronically controlled switch M1. As voltage VLEDSTRING continues to rise, the voltage at the source of electronically controlled switch M1 will rise until the gate-source voltage of electronically controlled switch M1 is less than the threshold voltage of electronically controlled switch M1, thereby opening electronically controlled switch M1. Similarly, as voltage VLEDSTRING continues to rise, each of the LEDs L2, L3 . . . LN lights in turn and the associated electronically controlled switch M2, M3 . . . MN is bypassed and opened.

When voltage VLEDSTRING begins to decrease, the last LED to be illuminated, e.g. LED LN fails to receive sufficient operating voltage. As long as fixed reference voltage VG is greater than the maximum voltage drop across current source 50, the associated electronically controlled switch MN is closed, since the gate voltage from fixed voltage source VG is greater than the voltage at the source of the associated electronically controlled switch MN. Thus, current bypasses the unlit LED LN and continues to flow through the balance of the serially connected LEDs. As voltage VLEDSTRING continues to fall, LEDs are extinguished sequentially, and the associated electronically controlled switch provided a bypass path.

Figure 7:
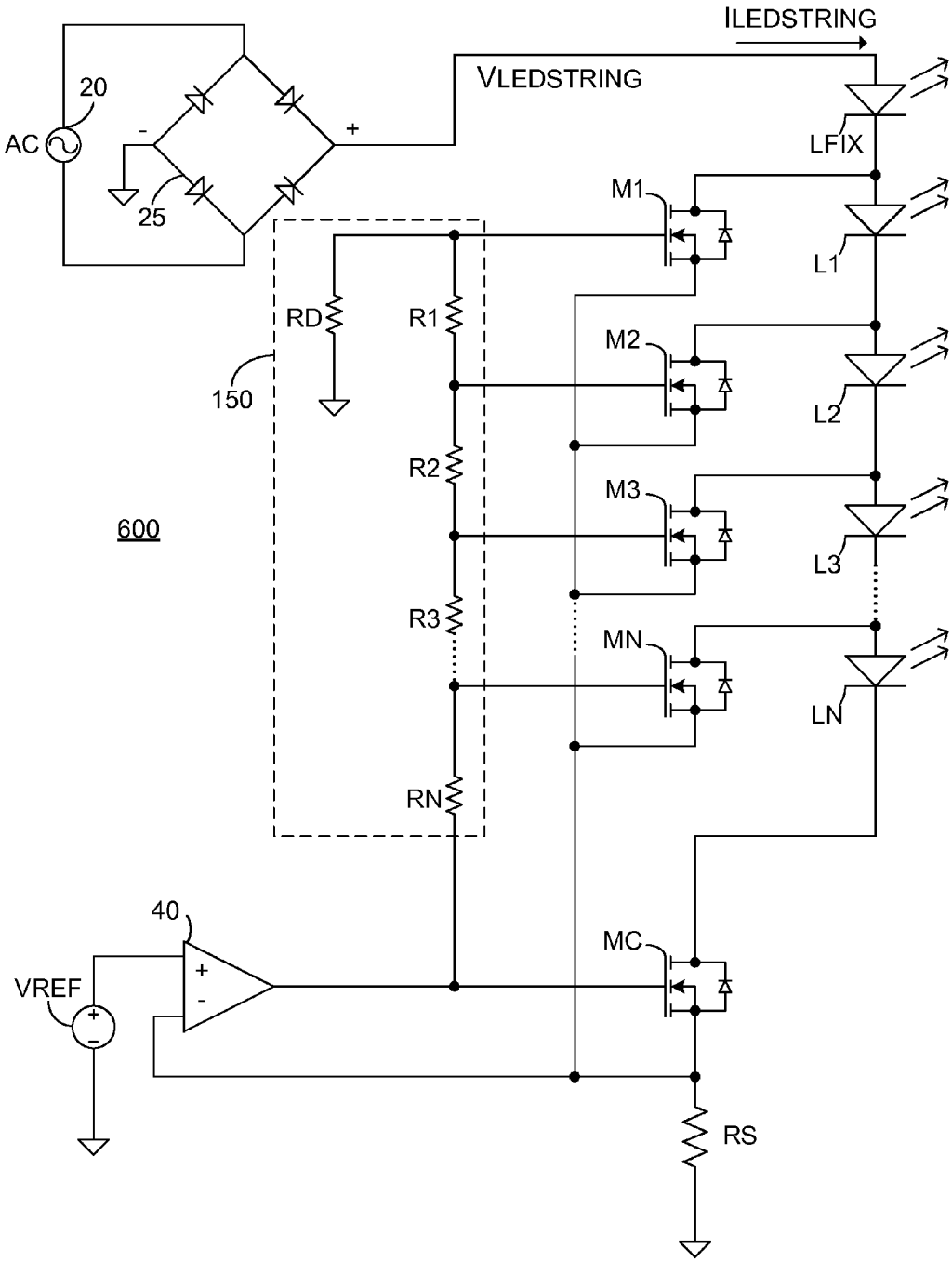
FIG. 7 illustrates a high level schematic diagram of a driving arrangement comprising a controlled current source, wherein the control inputs of the plurality of electronically controlled switches are coupled to respective nodes of a common voltage divider according to an exemplary embodiment.

FIG. 7 illustrates a high level schematic diagram of a driving arrangement 600 comprising a source of AC power 20; a full-wave rectifier 25; a plurality of LEDs L1, L2, L3 . . . LN; an optional additional LED LFIX; a plurality of electronically controlled switches M1, M2, M3 . . . MN, each associated with a particular light emitting diode L1, L2, L3 . . . LN; a control unit 150 constituted of a plurality of resistors RD, R1, R2, R3. RN; an electronically controlled switch MC; a sense resistor RS; a fixed reference voltage VREF; and a differential amplifier 40. In one embodiment each of the electronically controlled switches MC, M1, M2, M3 . . . MN are implemented as FETs, and are illustrated as NMOSFETs, however this is not meant to be limiting in any way. Driving arrangement 600 is being illustrated in relation to 4 serially connected LEDs and a single additional LED LFIX, however this is not meant to be limiting in any way, and additional LEDs may be serially connected, with an associated electronically controlled switch, between LED L3 and LED LN, without exceeding the scope. Similarly, a single additional LED LFIX is illustrated, however this is not meant to be limiting in any way, and a plurality of additional LEDs may be inserted serially connected to additional LED LFIX without exceeding the scope. Driving arrangement 600 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope. Electronically controlled switches M1, M2, M3 . . . MN and MC are preferably all nearly identical, exhibiting matched properties.

The phase side of source of AC power 20 is connected to a first input of full-wave rectifier 25 and the neutral side of source of AC power 20 is connected to a second input of full-wave rectifier 25. The negative output of full-wave rectifier 25 is connected to a common point. The positive output of full-wave rectifier 25 is connected to the anode of LED LFIX and the voltage at the output is denoted VLEDSTRING. The current entering the anode of additional LED LEDFIX is denoted ILEDSTRING. Optionally, a capacitor may be provided across the outputs of full-wave rectifier 25 reducing the voltage ripple, and preventing a drop out voltage at which no LEDs are lit.

The cathode of LED LFIX is connected to the anode of LED L1 and the drain of electronically controlled switch M1. The cathode of LED L1 is connected to the anode of LED L2 and the drain of electronically controlled switch M2. The cathode of LED L2 is connected to the anode of LED L3 and the drain of electronically controlled switch M3. The cathode of LED L3 is connected to the anode of LED LN and the drain of electronically controlled switch MN. The cathode of LED LN is connected to the drain of electronically controlled switch MC. The source of each of electronically controlled switches M1, M2, M3 . . . MN and MC is commonly connected to a first end of sense resistor RS and to the inverting input of differential amplifier 40. The gate of electronically controlled switch M1 is connected to a first end of resistor RD and a first end of resistor R1. The gate of electronically controlled switch M2 is connected to a second end of resistor R1 and a first end of resistor R2. The gate of electronically controlled switch M3 is connected to a second end of resistor R2 and a first end of resistor R3. The gate of electronically controlled switch MN is connected to a second end of resistor R3 and a first end of resistor RN, it being understood that resistor RN is connected to the second end of the resistor sequentially above. A second end of resistor RD is connected to the common point. The gate of electronically controlled switch MC is connected to the output of differential amplifier 40 and a second end of resistor RN. A second end of sense resistor RS is connected to the common point. The non-inverting input of differential amplifier 40 is connected to the positive output of fixed reference voltage VREF.

In operation, the gates of each of electronically controlled switches M1, M2, M3 . . . MN and MC are connected across a voltage divider, such that the gate voltage of electronically controlled switch MC is greater than the gate voltage of each of electronically controlled switches M1, M2, M3 . . . MN, the gate voltage of electronically controlled switch MN is greater than the gate voltage of each of electronically controlled switches M1, M2, M3, the gate voltage of electronically controlled switch M3 is greater than the gate voltage of each of electronically controlled switches M1, M2 and the gate voltage of electronically controlled switch M2 is greater than the gate voltage of electronically controlled switch M1. The source voltages of each of electronically controlled switches M1, M2, M3 . . . MN and MC are common. In the absence of any current flow, differential amplifier 40 drives its output towards the positive supply rail of differential amplifier 40, thereby closing each of electronically controlled switches M1, M2, M3 . . . MN and MC. As voltage VLEDSTRING increases past the operating voltage drop of additional LED LFIX, current ILEDSTRING flows through LED LFIX and electronically controlled switches M1, M2, M3 . . . MN and bypasses LEDs L1, L2, L3 . . . LN. Current ILEDSTRING then flows through sense resistor RS and differential amplifier 40 compares the voltage drop across sense resistor RS with fixed reference voltage VREF. Control unit 30 is operative to open and close certain of electronically controlled switches M1, M2, M3 . . . MN responsive to the output of differential amplifier 40 as will be described further hereinto below.

As the voltage drop across sense resistor RS increases and approaches fixed reference voltage VREF, the output of differential amplifier 40 decreases towards zero thus causing the channel resistance of electronically controlled switch M1 to increase so as to limit the current through sense resistor RS to not exceed the value represented by fixed reference voltage VREF. Electronically controlled switch M1 thus acts as a current limiter, since the gate voltage of electronically controlled switch M1 is lower than the gate voltage of any of electronically controlled switches M2, M3 . . . MN and MC. Thus, the gate-source voltage of electronically controlled switch M1 is lower than the gate-source voltage of any of electronically controlled switches M2, M3 . . . MN and MC.

The resistance values of resistors R1, R2, R3 . . . RN and RD are set so that when the voltage drop across the electronically controlled switch that is limiting current ILEDSTRING to the value represented by VREF reaches the minimal operating voltage drop across the associated LED, the gate-source voltage of the electronically controlled switch drops below the voltage threshold, thereby the electronically controlled switch opens completely as will be described below.

As voltage VLEDSTRING rises the voltage at the inverting input of differential amplifier 40 rises, and the gate voltage of electronically controlled switch M1 decreases. As the voltage drop across electronically controlled switch M1 reaches the minimal operating voltage drop across LED L1, current begins to flow through LED L1. Preferably, the gate voltage of electronically controlled switch M1 will have dropped low enough so that the gate-source voltage of electronically controlled switch M1 drops below the voltage threshold of electronically controlled switch M1, and thus electronically controlled switch M1 opens completely as current ILEDSTRING begins to flow through LED L1, however this is not required. In another embodiment, electronically controlled switch M1 opens completely only after voltage VLEDSTRING is sufficient to completely light LED L1. As described above, the gate voltage of electronically controlled switch M2 is greater than the gate voltage of electronically controlled switch M1. As a result, current flowing through LED L1 flows through electronically controlled switch M2 and through sense resistor RS. Current is now limited by electronically controlled switch M2.

As voltage VLEDSTRING continues to rise the voltage at the inverting input of differential amplifier 40 rises, and the gate voltage of electronically controlled switch M2 decreases. As the voltage drop across electronically controlled switch M2 reaches the minimal operating voltage drop across LED L2, LED L2 lights, and preferably the gate voltage of electronically controlled switch M2 will have dropped low enough so that the gate-source voltage of electronically controlled switch M2 drops below the voltage threshold of electronically controlled switch M2, and thus electronically controlled switch M2 opens completely and current ILEDSTRING begins to flow through LED L2, however this is not required. In another embodiment, electronically controlled switch M2 opens completely only after voltage VLEDSTRING is sufficient to completely light LED L2. As described above, the gate voltage of electronically controlled switch M3 is greater than the gate voltage of electronically controlled switch M2. As a result, current flowing through LED L2 flows through electronically controlled switch M3 and through sense resistor RS. Current is now limited by electronically controlled switch M3.

As voltage VLEDSTRING continues to rise the voltage at the inverting input of differential amplifier 40 rises, and the gate voltage of electronically controlled switch M3 decreases. As the voltage drop across electronically controlled switch M3 reaches the minimal operating voltage drop across LED L3, LED L3 lights, and preferably the gate voltage of electronically controlled switch M3 will have dropped low enough so that the gate-source voltage of electronically controlled switch M3 drops below the voltage threshold of electronically controlled switch M3, and thus electronically controlled switch M3 opens completely and current ILEDSTRING begins to flow through LED L3, however this is not required. In another embodiment, electronically controlled switch M3 opens completely only after voltage VLEDSTRING is sufficient to completely light LED L3. As described above, the gate voltage of electronically controlled switch MN is greater than the gate voltage of electronically controlled switch M3. As a result, current flowing through LED L3 flows through electronically controlled switch MN and through sense resistor RS. Current is now limited by electronically controlled switch MN.

As voltage VLEDSTRING rises the voltage at the inverting input of differential amplifier 40 rises, and the gate voltage of electronically controlled switch MN decreases. As the voltage drop across electronically controlled switch MN reaches the minimal operating voltage drop across LED LN, the gate voltage of electronically controlled switch MN will have dropped low enough so that the gate-source voltage of electronically controlled switch MN drops below the voltage threshold of electronically controlled switch MN, and thus electronically controlled switch MN opens completely and current ILEDSTRING begins to flow through LED LN, however this is not required. In another embodiment, electronically controlled switch MN opens completely only after voltage VLEDSTRING is sufficient to completely light LED LN. As described above, the gate voltage of electronically controlled switch MC is greater than the gate voltage of electronically controlled switch MN. As a result, current flowing through LED LN flows through electronically controlled switch MC and through sense resistor RS. Current is now limited by electronically controlled switch MC. In the event that voltage VLEDSTRING continues to rise, current continues to be limited by the action of electronically controlled switch MC in cooperation with differential amplifier 40.

When voltage VLEDSTRING begins to decrease, the voltage drop across sense resistor RS is reduced, thereby increasing the output of differential amplifier 40. The gate voltage of each of electronically controlled switches M1, M2, M3 . . . MN and MC increases, thereby reducing the channel resistance of the electronically controlled switch presently limiting the current so as to maintain the predetermined current associated with the value of fixed reference voltage VREF. The electronically controlled switch currently limiting the current reduces its channel resistance as the falling voltage VLEDSTRING is reflected in an increased gate-source voltage and the channel resistance of the electronically controlled switch serially adjacent thereto, and closer to the source of voltage VLEDSTRING, begins to rise. For example, if electronically controlled switch M2 is currently limiting the current, i.e. only LED L1 and additional LED LFIX are lit, and voltage VLEDSTRING decreases, electronically controlled switch M2 closes completely and the channel resistance of electronically controlled switch M1 rises. LED L1 fails to receive sufficient operating voltage and current begins to flow through electronically controlled switch M1, which now acts as a current limiter.

Figure 8:
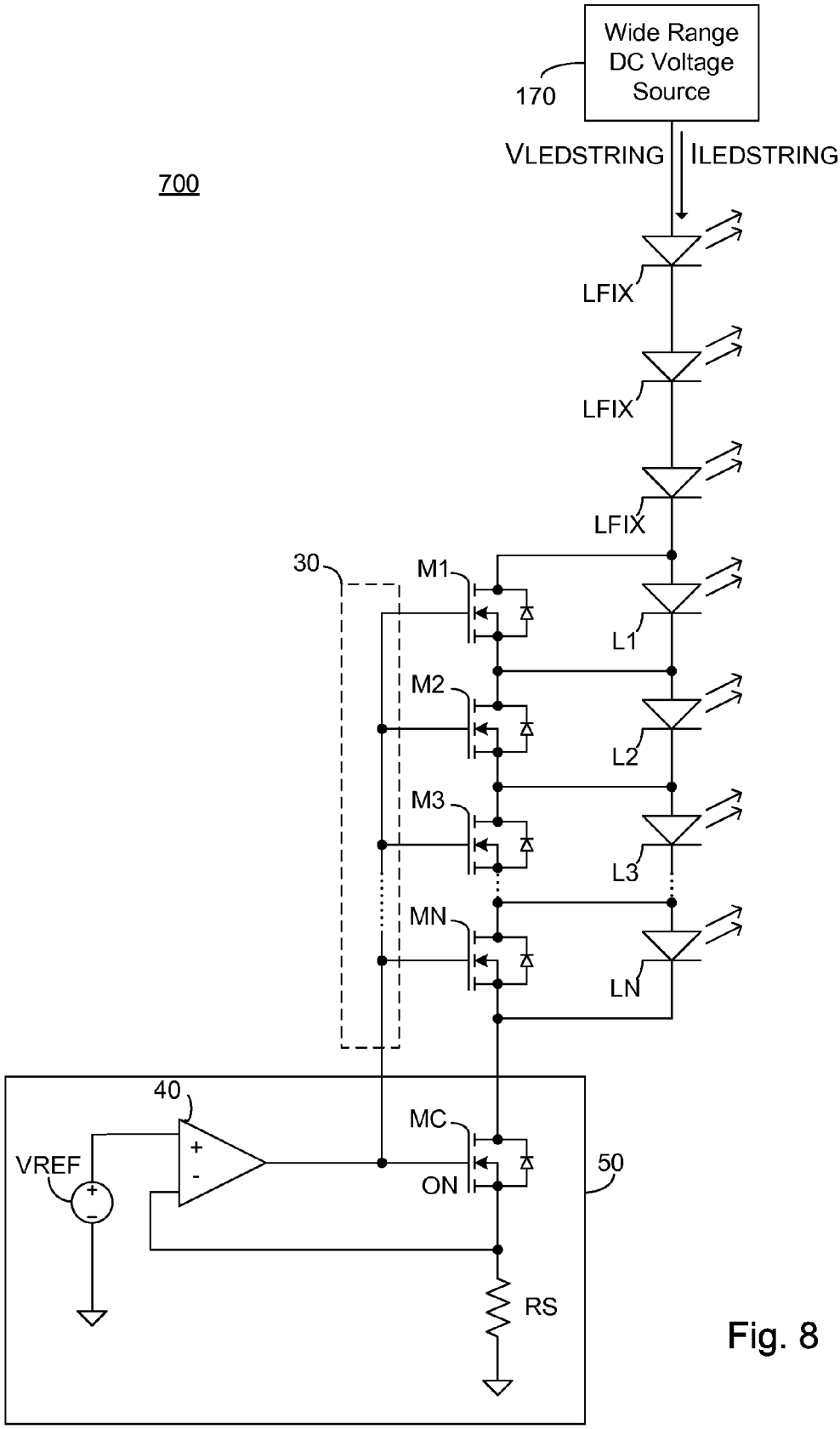
FIG. 8 illustrates a high level schematic diagram of a driving arrangement comprising a controlled current source, the driving arrangement coupled to a DC voltage source exhibiting a range of values according to an exemplary embodiment.

FIG. 8 illustrates a high level schematic diagram of the operation of a driving arrangement 700 comprising a wide range DC voltage source 170; a plurality of LEDs L1, L2, L3 . . . LN; a string of optional additional LEDs LFIX; a plurality of electronically controlled switches M1, M2, M3 . . . MN, each associated with a particular light emitting diode L1, L2, L3 . . . LN; a control unit 30 constituted of a common connection to the gates of electronically controlled switches M1, M2, M3 . . . MN; and a current source 50. Current source 50 comprises an electronically controlled switch MC, a sense resistor RS, a fixed reference voltage VREF and a differential amplifier 40. Wide range DC voltage source 170 exhibits a range of values, preferably the range of values does not go below the value needed to light all of additional LEDs LFIX and the minimal voltage drop developed across electronically controlled switches M1, M2, M3 . . . MN and MC. In one embodiment each of the electronically controlled switches MC, M1, M2, M3 . . . MN are implemented as FETs, and are illustrated as NMOSFETs, however this is not meant to be limiting in any way. Driving arrangement 700 is being illustrated in relation to 4 serially connected LEDs and 3 additional LEDs LFIX, however this is not meant to be limiting in any way, and additional LEDs may be serially connected, with an associated electronically controlled switch, between LED L3 and LED LN, without exceeding the scope. Similarly, 3 additional LEDs LFIX are illustrated, however this is not meant to be limiting in any way, and a plurality of additional LEDs may be inserted serially connected to additional LEDs LFIX without exceeding the scope. Driving arrangement 700 may be provided with fewer than 4 serially connected LEDs without exceeding the scope. LED LFIX need not be of the same type as LEDs L1-LN, and each of LEDs LFIX and LEDs L1-LN may be provided with an internal protection breakdown diode arranged to allow current flow there through in the event of failure without exceeding the scope. Electronically controlled switches M1, M2, M3 . . . MN and MC are preferably all nearly identical, exhibiting matched properties.

The output of wide range DC voltage source 170 is connected to the anode of the first LED of the string of additional LEDs LFIX and the voltage at the output is denoted VLEDSTRING. The current entering the plurality of additional LEDs LFIX is denoted ILEDSTRING. The cathode of the last LED of the string of additional LEDs LFIX is connected to the anode of LED L1 and the drain of electronically controlled switch M1. The cathode of LED L1 is connected to the anode of LED L2, the source of electronically controlled switch M1 and the drain of electronically controlled switch M2. The cathode of LED L2 is connected to the anode of LED L3, the source of electronically controlled switch M2 and the drain of electronically controlled switch M3. The cathode of LED L3 is connected to the anode of LED LN, the source of electronically controlled switch M3 and the drain of electronically controlled switch MN. The cathode of LED LN is connected to the source of electronically controlled switch MN and the drain of electronically controlled switch MC. The gate of each of plurality of electronically controlled switches M1, M2, M3 . . . MN and MC is connected to the output of differential amplifier 40. The source of electronically controlled switch MC is connected to a first end of sense resistor RS and the inverting input of differential amplifier 40. A second end of sense resistor RS is connected to the common point. The non-inverting input of differential amplifier 40 is connected to fixed reference voltage VREF.

In operation, wide range DC voltage source 170 outputs a DC voltage which may exhibit a wide range of values. The number of additional LEDs LFIX is preferably selected to provide a minimum desired luminance for the lowest expected voltage output of wide range DC voltage source 170. In one non-limiting example, the range of values exhibited by the voltage output of wide range DC voltage source 170 represents the allowed range of values received by a powered device in accordance with power over Ethernet, as defined in standard IEEE 802.3af-2003. Driving arrangement 700 operates similar to driving arrangements 200, 300 and 400 of FIGS. 3A-3C and 4, respectively, where the luminance provided by the string of additional LEDs LFIX and LEDs L1, L2, L3 . . . LN is responsive to the value of the voltage output from wide range DC voltage source 170.

Figure 9:
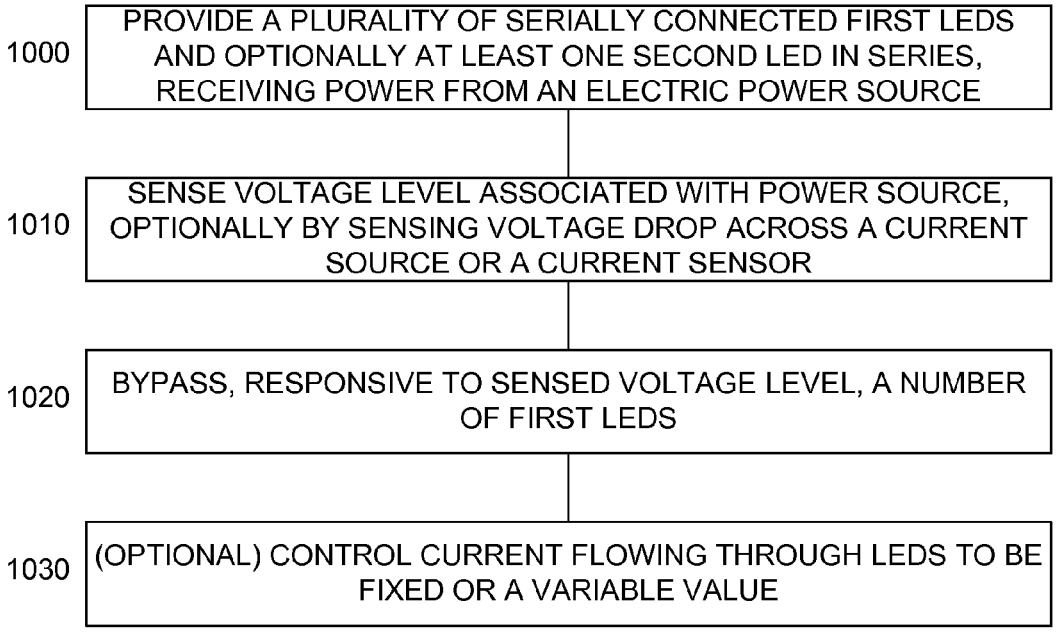
FIG. 9 illustrates a high level flow chart of a method according to an exemplary embodiment.

FIG. 9 illustrates a high level flow chart of a method according to an exemplary embodiment. In stage 1000 a plurality of serially connected first LEDs and, optionally, at least one second LED, such as additional LEDs LFIX of FIGS. 1, 2A, 2B, 3A-3C, 4, 6, 7 and 8, in series with serially connected first LEDs are provided. The provided LEDs receive power from an electric power source, such as AC power source 20 or wide range DC power source 170. In stage 1010 a voltage level associated with the electric power source of stage 1000 is sensed, preferably the instantaneous value of the voltage level is sensed. In one embodiment sensing is done by sensing a voltage drop across a current source, as described above in relation to FIGS. 3A-3C and 4. In another embodiment sensing is done by sensing a voltage drop across a sense resistor, as described above in relation to FIG. 2B. In another embodiment sensing is done by control unit 30 of FIG. 1. In yet another embodiment sensing is done by electronically controlled switches M1, M2, M3, MN as described above in relation to FIG. 6. In stage 1020, responsive to the sensed voltage level of stage 1010, a number of first LEDs are bypassed, thereby current will not flow through them. In optional stage 1030 the current flowing through first and optional second LEDs of stage 1000 is controlled, as described above in relation to FIGS. 1, 3A-3C, 4, and 6-8. The current can be controlled to be either a fixed value, as described above in relation to FIG. 5A, or a variable value being a function of the voltage output from the electric power source of stage 1000, as described above in relation to FIG. 5B.

Thus certain of the present embodiments enable a driving arrangement comprising a plurality of serially connected LEDs, with a plurality of associated electronically controlled switches, each of the electronically controlled switches arranged to provide a bypass path for each of the serially connected LEDs. The electronically controlled switches are controlled so as to bypass serially connected LEDs in reverse proportion to a supply voltage, preferably to the instantaneous value of the supply voltage. As the supply voltage increases, fewer of the serially connected LEDs are bypassed, and the output light increases, and as the supply voltage decreases, more of the serially connected LEDs are bypassed, and the output light decreases.

In one embodiment, one end of the serially connected LEDs is connected to a current source, preferably a controlled current source. In another embodiment, one end of the serially connected LEDs is connected to a current sensor.

In one embodiment the driving arrangement further comprises a fixed LED string connected in series with the serially connected LEDs, the fixed LED string providing a predetermined voltage drop and minimum illumination.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. A driving arrangement for a plurality of light emitting diodes (LEDs), the driving arrangement comprising:

a plurality of serially connected first LEDs coupled to a source voltage;

a plurality of first electronically controlled switches, each associated with a particular one of the plurality of serially connected first LEDs and arranged to provide, when closed, a bypass current path for said associated first LED;

a control circuitry coupled to a control terminal of each of said plurality of first electronically controlled switches, said control circuitry arranged to close a number of said plurality of first electronically controlled switches, said number responsive to a voltage level of the source voltage;

a second LED serially coupled with said plurality of serially connected first LEDs;

a second electronically controlled switch arranged to provide, when closed, a bypass current path for said second LED, said control circuitry coupled to a control terminal of the second electronically controlled switch; and a plurality of thermal sensors each associated with one of the plurality of serially connected first LEDs, the output of each of said thermal sensors coupled to said control circuitry, wherein said control circuitry is further arranged to monitor said plurality of thermal sensors, and in the event that the output of any of said thermal sensors are indicative that the temperature of the associated LED has exceeded a predetermined value, said control circuitry is arranged to close said first electronically controlled switch associated with said LED exhibiting said excessive temperature thereby bypassing said LED exhibiting said excessive temperature, and substitute said second LED and said second electronically controlled switch for said LED exhibiting said excessive temperature and said associated first electronically controlled switch.

2. A driving arrangement according to claim 1 wherein said control circuitry is further arranged to monitor an electrical characteristic associated with the first LEDs, and in the event that said monitored electrical characteristic is indicative of a failure of a particular one of said plurality of first LEDs, said control circuitry is arranged to close said first electronically controlled switch associated with said LED exhibiting said failure thereby bypassing said LED exhibiting said failure, and substitute said second LED and said second electronically controlled switch for said LED exhibiting said failure and said associated first electronically controlled switch.

3. A driving arrangement for a plurality of light emitting diodes (LEDs), the driving arrangement comprising:

a plurality of serially connected first LEDs coupled to a source voltage;

a plurality of first electronically controlled switches, each associated with a particular one of the plurality of serially connected first LEDs and arranged to provide, when closed, a bypass current path for said associated first LED;

a control circuitry coupled to a control terminal of each of said plurality of first electronically controlled switches, said control circuitry arranged to close a number of said plurality of first electronically controlled switches, said number responsive to a voltage level of the source voltage;

a second LED serially coupled with said plurality of serially connected first LEDs; and a second electronically controlled switch arranged to provide, when closed, a bypass current path for said second LED, said control circuitry coupled to a control terminal of the second electronically controlled switch, wherein said control circuitry is further arranged to monitor an electrical characteristic associated with the first LEDs, and in the event that said monitored electrical characteristic is indicative of a failure of a particular one of said plurality of first LEDs, said control circuitry is arranged to close said first electronically controlled switch associated with said LED exhibiting said failure thereby bypassing said LED exhibiting said failure, and substitute said second LED and said second electronically controlled switch for said LED exhibiting said failure and said associated first electronically controlled switch.

4. A method of driving a light emitting diode (LED) based luminaire, said method comprising:

providing a plurality of serially connected first LEDs arranged to receive power from an electrical power source;

sensing the voltage level associated with the electrical power source;

bypassing, responsive to said sensed voltage level, a number of said serially connected first LEDs;

providing a second LED serially coupled with said provided plurality of serially connected first LEDs;

providing an electronically controlled switch arranged to provide, when closed, a bypass current path for said provided second LED;

monitoring the temperature associated with each of said provided first LEDs; and in the event that the temperature associated with any of said provided first LEDs has exceeded a predetermined value, bypassing said LED exhibiting said excessive temperature, and substituting said provided second LED and said provided electronically controlled switch for said LED exhibiting said excessive temperature.

5. A method according to claim 4, further comprising:

monitoring an electrical characteristic of the provided first LEDs; and in the event that said monitored electrical characteristic is indicative of a failure of a particular one of said plurality of first LEDs, bypassing said LED exhibiting said failed LED, and substituting said provided second LED and said provided electronically controlled switch for said LED exhibiting said failure.

6. A method of driving a light emitting diode (LED) based luminaire, said method comprising:

providing a plurality of serially connected first LEDs arranged to receive power from an electrical power source;

sensing the voltage level associated with the electrical power source;

bypassing, responsive to said sensed voltage level, a number of said serially connected first LEDs;

providing a second LED serially coupled with said provided plurality of serially connected first LEDs;

providing an electronically controlled switch arranged to provide, when closed, a bypass current path for said provided second LED;

monitoring an electrical characteristic of said provided plurality of serially connected first LEDs; and in the event that said monitored electrical characteristic is indicative of a failure of a particular one of said plurality of first LEDs, bypassing said failed LED, and substituting said provided second LED and said provided electronically controlled switch for said failed LED.

* * * * *